US010260803B2

(12) United States Patent
Nordahl

(10) Patent No.: US 10,260,803 B2
(45) Date of Patent: Apr. 16, 2019

(54) METHOD, A SYSTEM AND DEVICES FOR PROCESSING AT LEAST ONE SUBSTANCE IN A DRIED, FRAGMENTED, FLUIDIZED END PRODUCT

(71) Applicant: WAISTER AS, Sem (NO)

(72) Inventor: Geir Nordahl, Våle (NO)

(73) Assignee: WAISTER AS, Sem (NO)

( * ) Notice: Subject to any disclaimer, the term of this patent is extended or adjusted under 35 U.S.C. 154(b) by 501 days.

(21) Appl. No.: 14/892,551

(22) PCT Filed: May 20, 2014

(86) PCT No.: PCT/NO2014/050080

§ 371 (c)(1),
(2) Date: Nov. 19, 2015

(87) PCT Pub. No.: WO2014/189384

PCT Pub. Date: Nov. 27, 2014

(65) Prior Publication Data

US 2016/0091246 A1 Mar. 31, 2016

(30) Foreign Application Priority Data

May 22, 2013 (NO) ..... 20130713
May 22, 2013 (NO) ..... 20130716
(Continued)

(51) Int. Cl.
*F26B 1/00* (2006.01)
*F26B 3/08* (2006.01)
(Continued)

(52) U.S. Cl.
CPC ..... *F26B 1/005* (2013.01); *B02C 18/06* (2013.01); *B02C 18/30* (2013.01); *F26B 3/08* (2013.01);
(Continued)

(58) Field of Classification Search
CPC ..... F26B 1/005; F26B 17/103; F26B 21/08; F26B 21/086; F26B 3/092; F26B 3/0923;
(Continued)

(56) References Cited

U.S. PATENT DOCUMENTS 695,878 A 3/1902 Geiger et al.
3,384,138 A * 5/1968 Johnson ..... A01F 11/06 241/101.01
(Continued)

FOREIGN PATENT DOCUMENTS

CN 201852410 U 6/2011
CN 102230723 A 11/2011
(Continued)

*Primary Examiner* — John P McCormack
(74) *Attorney, Agent, or Firm* — Knobbe, Martens, Olson & Bear, LLP

(57) ABSTRACT

A method, a system and devices are for processing of at least one substance into a dried, fragmented and fluidized end product. The at least one substance is delivered in fragmented state from a fragmenting device to a fluidizing, drying and filtering unit. The at least one fragmented substance is subjected to fluidizing action from at least one set of rotary shovels while blowing a drying agent (DA), e.g. hot gas, hot air, vapor or superheated steam into a space of the unit. The drying agent, having passed through fluidized, fragmented substance(s), is sucked and filtered to let it exit a space at an upper end or lateral region thereof. Further, the fragmented, fluidized and dried substance(s) are caused to leave the space at a lower region thereof as the product. Humid drying agent exiting the space is at least partly de-hydrated and/or heated before re-entering the space.

11 Claims, 22 Drawing Sheets

(30) Foreign Application Priority Data

May 22, 2013 (NO) ..... 20130717
May 22, 2013 (NO) ..... 20130718

(51) Int. Cl.

| | |
|---|---|
| ***F26B 3/092*** | (2006.01) |
| ***F26B 21/08*** | (2006.01) |
| ***B02C 18/06*** | (2006.01) |
| ***B02C 18/30*** | (2006.01) |
| ***F26B 21/04*** | (2006.01) |
| ***F26B 25/00*** | (2006.01) |
| *B01F 7/00* | (2006.01) |

(52) U.S. Cl.
CPC ..... *F26B 3/0923* (2013.01); *F26B 21/04* (2013.01); *F26B 21/08* (2013.01); *F26B 21/086* (2013.01); *F26B 25/00* (2013.01); *B01F 7/00275* (2013.01)

(58) Field of Classification Search
CPC .... B02C 2/00; B02C 18/06; B01J 8/38; B01J 8/382
USPC ..... 34/397; 366/342, 343; 83/675; 241/299, 260, 260.1
See application file for complete search history.

(56) References Cited

U.S. PATENT DOCUMENTS

| | | | |
|---|---|---|---|
| 3,392,455 | A | 7/1968 | Kingsbaker et al. |
| 3,605,275 | A | 9/1971 | Enders |
| 3,830,150 | A | 8/1974 | Retrum |
| 3,895,958 | A | 7/1975 | Gill et al. |
| 3,941,357 | A | 3/1976 | Wurtz |
| 4,278,355 | A | 7/1981 | Forberg |
| 4,591,335 | A | 5/1986 | Buxel et al. |
| 5,810,476 | A | 9/1998 | Muentener |
| 5,984,520 | A | 11/1999 | Nordahl |
| 6,354,727 | B1 | 3/2002 | Toyoda et al. |
| 2001/0038050 | A1 | 11/2001 | Galletti |
| 2004/0240316 | A1 | 12/2004 | Nogi et al. |
| 2009/0211274 | A1 | 8/2009 | Meng |
| 2010/0276526 | A1* | 11/2010 | Shin-Ya ..... B02C 18/0084 241/101.5 |
| 2011/0067262 | A1 | 3/2011 | Eero |
| 2012/0167719 | A1* | 7/2012 | Newman ..... H01B 15/006 81/9.51 |

FOREIGN PATENT DOCUMENTS

| | | | |
|---|---|---|---|
| CN | 202141307 | U | 2/2012 |
| EP | 0611937 | A1 | 8/1994 |
| EP | 1408157 | A2 | 4/2004 |
| EP | 2511637 | A1 | 10/2012 |
| FR | 2342763 | A1 | 9/1977 |
| GB | 768635 | A | 2/1957 |
| GB | 2070751 | A | 9/1981 |
| GB | 2315975 | A | 2/1998 |
| JP | 03-075826 | U | 7/1991 |
| JP | 05-131184 | A | 5/1993 |
| JP | 05-337458 | A | 12/1993 |
| JP | 10-296065 | A | 11/1998 |
| JP | 2000-317290 | A | 11/2000 |
| JP | 2002-331275 | A | 11/2002 |
| JP | 2005-193185 | A | 7/2005 |
| JP | 2008-173605 | A | 7/2008 |
| JP | 3158237 | U | 3/2010 |
| JP | 2016-515305 | A | 5/2016 |
| KR | 20090075916 | A | 7/2009 |
| KR | 10-2013-0031002 | A | 3/2013 |
| WO | 83/01910 | A1 | 6/1983 |
| WO | 98/39087 | A1 | 9/1998 |
| WO | 03/052336 | A1 | 6/2003 |
| WO | 2011011171 | A1 | 1/2011 |

* cited by examiner

METHOD, A SYSTEM AND DEVICES FOR PROCESSING AT LEAST ONE SUBSTANCE IN A DRIED, FRAGMENTED, FLUIDIZED END PRODUCT

CROSS-REFERENCE TO RELATED APPLICATIONS

This application is the U.S. National Phase under 35. U.S.C. § 371 of International Application PCT/NO2014/050080, filed May 20, 2014, which claims priority to Norwegian Patent Application No. 20130713, filed May 22, 2013, Norwegian Patent Application No. 20130716, filed May 22, 2013, Norwegian Patent Application No. 20130717, filed May 22, 2013, Norwegian Patent Application No. 20130718, filed May 22, 2013. The disclosures of the above-described applications are hereby incorporated by reference in their entirety.

FIELD OF THE INVENTION

The present invention relates to a method, a system and devices for processing at least one substance into a dried, fragmented, fluidized end product.

In a first aspect, the present invention relates to a method and a system for processing at least one substance into a dried, fragmented, fluidized end product.

In a second aspect, the present invention relates to a substance fragmenting device for preparing at least one substance for further processing.

In a third aspect, the present invention relates to a device for fluidizing and drying at least one substance which in a fragmented state is received in a confined space of the device.

In a fourth aspect, the present invention relates to a device for fluidizing at least one substance which in a fragmented state is received in a confined space of the device.

In a fifth aspect, the present invention relates to a device for fluidizing at least one substance which in a fragmented state is received in a confined space of the device.

In this context, if there is processed more than one substance, i.e. delivered to the system as a mixture of substances, there could be a variety of types of substances, such as e.g. one or more organic and non-organic types, or one or more types within a single category. Types of material to be processed could e.g. be edible or non-edible material, fabrics, plastics, sheet metal, ingredients for making other products, or ingredients to be processed as waste material.

Other applications are treatment of substances to yield an end product by the method and system of the invention, such end product being useful for making an industrial product through use of a further and different method and apparatus.

Although the present invention is to be described relative to handling of waste material, this is no way to be construed as limiting the scope of the invention, as the invention could just as well be used for processing constituents for subsequently making edible products, such as e.g. from seafood, meat and/or vegetables, or products for use in making e.g. pharmaceuticals and fertilizers.

TECHNICAL BACKGROUND OF THE INVENTION

In grocery shops selling edible products, such as meat, fish, fruit, vegetables etc., it is a well known challenge to dispose of products that are overdue as regards final date for selling or which have decayed in quality. Not only the volume, but also any smell, moisture and commenced deterioration caused by bacteria, fermentation and/or fungi are severe environmental problems. Also there is a high risk of attracting mice and rats or other harmful creatures. To a certain extent, public sanitary services provide regular collection and can transport to an incineration plant or a biogas plant, but the waste is often smelly and wet, yielding dripping from the collection container.

However, treating products like these may in some circumstances present health hazards to personnel handling such goods. Further, many such products are associated with packaging such as e.g. sheet metal boxes, metal or plastic lined containers, plastic, cardboard, cellulose-based or cornflour based trays, cling film or blister-packs. It is also a challenge that it is a time-consuming and sometimes indeed a messy job to remove packaging for source-type sorting.

Not only in grocery shops, but also in catering activities, hotels, restaurants, public health institutions (e.g. hospitals or old-people homes), onboard ships and offshore installations, and collection services from trains and aircrafts, handling of waste in a hygienic way is a daily and serious challenge.

In this context it is important to be able to reduce the volume and weight of substance(s) and produce a dried end product material which is substantially homogeneous per unit volume and is hygienic in accordance to laws and legislations, i.e. by EU. Volume is suitably reduced through fragmentation. However, it is a challenge with prior art shredders to obtain satisfactory fragmentation of e.g. grocery substance(s) and wrapping or packaging related thereto. This challenge is dealt with in the second aspect of the invention.

In the context of the first, third, fourth and fifth aspects of the invention, there is in the prior art known numerous devices for mixing and/or fluidizing particles or fragmented substances, or fluidizing at least one fragmented substance. Such devices are at least partly described in inter alia the Norwegian patent applications 19890434, 19905274 (=NO-patent 176552), 19931642 (=NO-patent 177415 or U.S. Pat. No. 5,984,520 or EP-patent 0738182), 19952255 (=PCT-publication WO96/404422), 19971044 (=NO-patent 306242), and 20021512.

Further, a method and a plant for pre-treatment of source separated wet organic waste is known from Norwegian patent application 20035803 (=WO2005/061114-A1). Another reference is an article entitled "Microbial Inactivation during Superheated Steam Drying of Fish Meal" by Halvor Nygaard and Oistein Hostmark", Drying Technology, 26:222-230, 2008; URL: http://dx.doi.org/10.1080/07373930701831648

OBJECTS OF THE INVENTION

According to the first aspect of the invention, the present method and system has as an object to provide means for processing at least one substance into a fragmented or shredded, fluidized and dried product to overcome the well known disadvantages and hazards of the prior art handling of e.g. waste material or the challenges met in processing substances or materials destined for further use.

According to the second aspect of the present invention, it is an object to provide a device for processing at least one substance into a fragmented or shredded state suitable for any further desirable processing.

According to the third aspect of the invention, the present invention has as an object to provide means for processing at least one substance into a fragmented or shredded, fluidized and dried product to overcome the well known disadvantages and hazards of the prior art handling of e.g. waste material or the challenges met in processing substances or materials destined for further use.

According to the fourth and fifth aspects of the invention, it is an object to provide means for substantially improved fluidization of at least one substance which is in a fragmented or shredded state to enable such substance(s) to be efficiently further processed, e.g. in a drying and/or fluidizing process, to yield a more satisfactory end product to be output and destined for further use.

SUMMARY OF THE INVENTION

According to the first aspect of the invention, the method comprises:

a) delivering said at least one substance in fragmented state to a fluidizing, drying and filtering unit, b) subjecting the at least one fragmented substance to fluidizing action from at least one set of rotary shovels while blowing a drying agent via a heater into a substance fluidizing and drying space of the unit, c) sucking and filtering the drying agent having passed through the fluidized, fragmented substance(s) to let it exit said space at an upper end or lateral region thereof, d) feeding at least part of the drying agent being humid and exiting said space to a heat exchanger to de-hydrate the drying agent and to deliver de-hydrated, drying agent to the heater before re-entry of the drying agent into said space, and e) causing the fragmented, fluidized and dried substance(s) to leave said space at a lower region thereof as said product.

According to the first aspect of the invention, the system comprises:

a) a substance supply device capable at an output thereof to provide said at least one substance in a fragmented state, b) a fluidizing, drying and filtering unit which is configured to receive in a space thereof said at least one substance in fragmented state at a first input thereof, c) at least one set of rotary shovels located in said space, d) a second input of the space configured to receive a drying agent via a drying agent heater for injection into a substance fluidizing and drying space of the unit, subjecting the at least one fragmented substance to fluidizing action from said at least one set of shovels, e) a filtering unit located in said space and above or laterally relative to said at least one set of rotary shovels, f) drying agent exit means located in communication with the filtering unit at an upper end or at a lateral region of said space to allow exit flow of humid drying agent having passed through the fluidized, fragmented substance(s) to exit said space, g) a feeder device for humid drying agent in communication with an inlet on a heat exchanger enabling at least part of drying agent exiting said space to be fed to the heat exchanger which is configured to de-hydrate the humid drying agent received, the heat exchanger having an outlet communicating with the heater to deliver de-hydrated drying agent from the heat exchanger into the space via the heater, and h) a space exit to allow the fragmented, fluidized and dried substance(s) to leave said space as said end product.

It will be appreciated that the method is composed of an array of specific processes, and the system is likewise based on the provision a plurality of co-operating devices.

According to the second aspect of the invention there is provided a substance fragmenting device capable at an output thereof to provide said at least one substance in a fragmented state, comprising:

a feed-in means, e.g. a hopper, a screw conveyor, and a shredder at a downstream end of the conveyor for fragmentation of the at least one substance before delivering it at an output of the device, wherein the shredder comprises a set of angularly mutually spaced, stationary first knives and a set of angularly mutually spaced, rotary second knives downstream of the set of first knives and in interaction therewith, and wherein a downstream end of a conveying screw of the screw conveyor is spaced from an upstream face of said set of first knives.

According to the third aspect of the invention there is provided a device for fluidizing and drying at least one substance which in a fragmented state is received in a confined space of the device, the device comprising:

at least one set of rotary shovels located in said space, an input of the space configured to receive drying agent via a heater for injection into fragmented substance(s), the at least one fragmented substance being subjected to fluidizing action from said at least one set of shovels, wherein a filtering unit is located in said space and above or laterally relative to said at least one set of rotary shovels, such set being attached to a rotary shaft, wherein drying agent exit means are located in communication with the filtering unit at an upper end or at a lateral region of said space to allow flow of humid drying agent which has passed through the fluidized substance(s) to exit said space, wherein a feeder device for humid drying agent in communication with an inlet on a heat exchanger is configured to enable at least part of drying agent exiting said space to be fed to the heat exchanger which is configured to de-hydrate the humid drying agent received, the heat exchanger having an outlet communicating with the heater to deliver de-hydrated drying agent from the heat exchanger to the heater, and wherein the space has at least one outlet enabling the fragmented, fluidized and dried substance(s) to leave said space as an end product.

According to the fourth aspect of the invention there is provided a device for fluidizing of at least one substance which in a fragmented state is received in a confined space of the device, comprising:

at least one set of rotary shovels located in said space, the at least one set of rotary shovels being located on a common rotary shaft of the set, the shaft being configured to rotate in a first rotating mode when operating to fluidize the fragmented substance(s), wherein the shovels of the at least one set of shovels extend radially from a respective surface of the common rotary shaft of the set, wherein each shovel, as viewed radially from the rotary shaft, has a curved cross-section so as to present upon rotation of the set of shovels a convex surface to face the fragmented substance(s) to be fluidized, wherein the shovel at an radially outer region is forwardly flared in a direction of a fluidizing mode of rotation, the outer region thereby having a forward face forming an angle with the rotary forwardly facing convex surface of the remainder if the shovel, and wherein the space has at least one outlet enabling the fragmented, fluidized substance(s) to leave said space at a lower region thereof as an end product.

In one refinement of the characteristic features, at least two sets of rotary shovels are located in said space, the at least two sets of rotary shovels being located on a respective rotary shaft, the shafts having parallel rotary axes and being configured to rotate in a first mutually counter-rotating mode when operating to fluidize the fragmented substance(s), and wherein the directions of rotation of the at least two sets of shovels being mutually reversed upon a phase of operation causing the end product to leave the space, thereby yielding a second mutually counter-rotating mode.

In another refinement of the characteristic features, a concave side of the shovel between said outer region and the respective surface of the shaft is covered by a plate member extending between side edges of the shovel.

In still another refinement of the characteristic features, an aerodynamic member, e.g. having a drop shaped or wedge shaped configuration extends rearwards from the concave side of the shovel, transversely of the radial direction of the shovel.

In yet another refinement of the characteristic features as well as a possible modification of the just mentioned refinements, a radially extending side edge region of the shovel is provided with a wing-like side member protruding laterally from said side edge region.

In a fifth aspect, being a variant of the just mentioned fourth aspect of the invention device and its refinements/modification, the inventive device comprises:

at least one set of rotary shovels located in said space, the at least one set of rotary shovels being located on a rotary shaft, the shaft being configured to rotate in a first rotating mode when operating to fluidize the fragmented substance(s), wherein the shovels of the at least one set of shovels extend radially from a respective surface of a common rotary shaft of the set, wherein each shovel, as viewed radially from the rotary shaft, has a curved cross-section so as to present upon rotation of the set of shovels a convex surface to face the fragmented substance(s) to be fluidized, wherein a radially extending side edge region of the shovel is provided with a wing-like side member protruding laterally from said side edge region, the wing-like side member being turned forwardly in the direction of rotation of the shovel, so as to form an angle with an edge of the convex side of the shovel, and wherein the space has at least one outlet enabling the fragmented, fluidized substance(s) to leave said space at a lower region thereof as an end product.

The invention is now to be described with reference to the following description and with reference to the attached drawings, and which describe and illustrate non-limiting examples of the presented embodiments related to handling of e.g. waste material in groceries, although other types of material handling or processing lies with the concepts and teachings of the present invention.

DETAILED DESCRIPTION OF THE INVENTION

Figure 1:
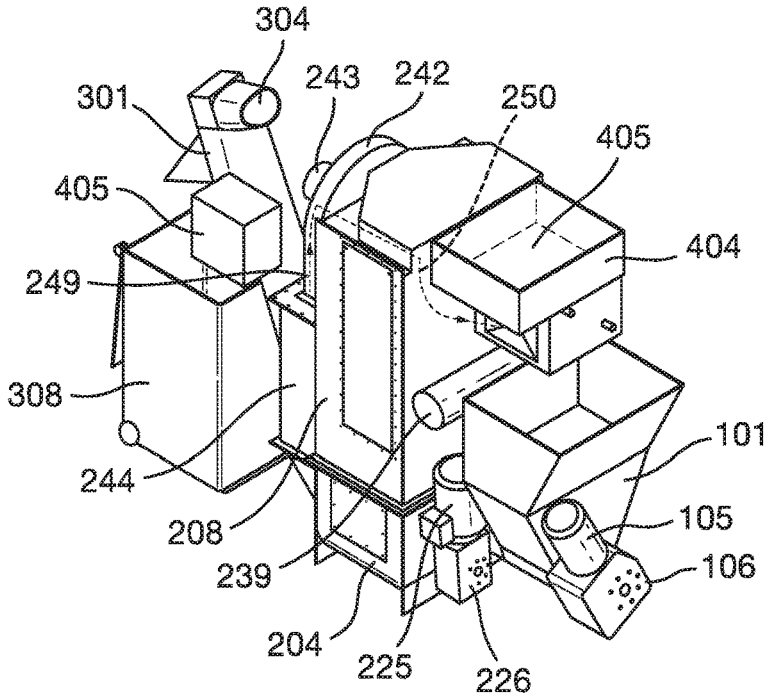
FIG. 1 shows in a front perspective view and from one end the inventive system for carrying out the method of the invention.
Figure 2:
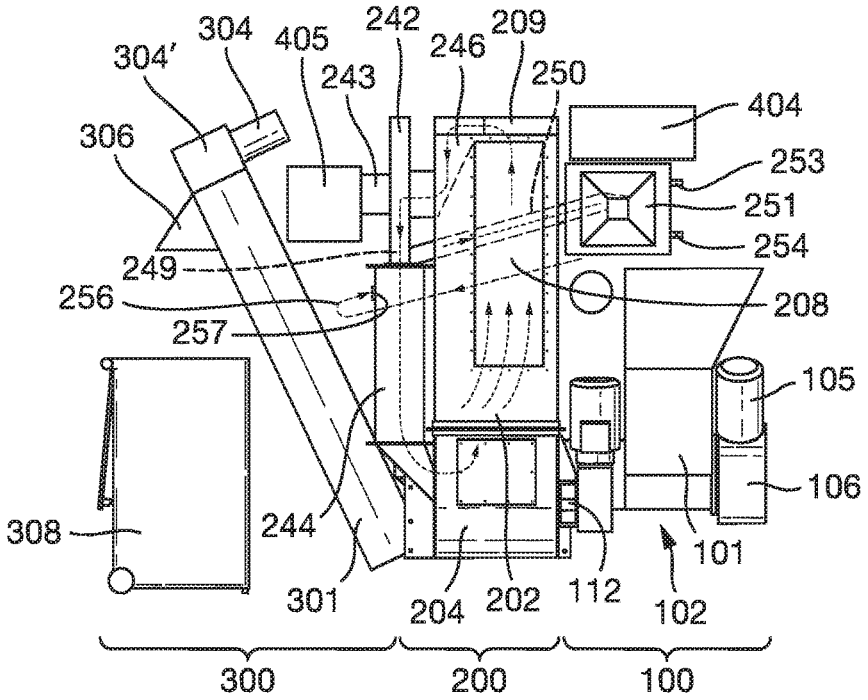
FIG. 2 is a side view of one side of the system of FIG. 1, illustrating in general first, second and third sections of the system.
Figure 3:
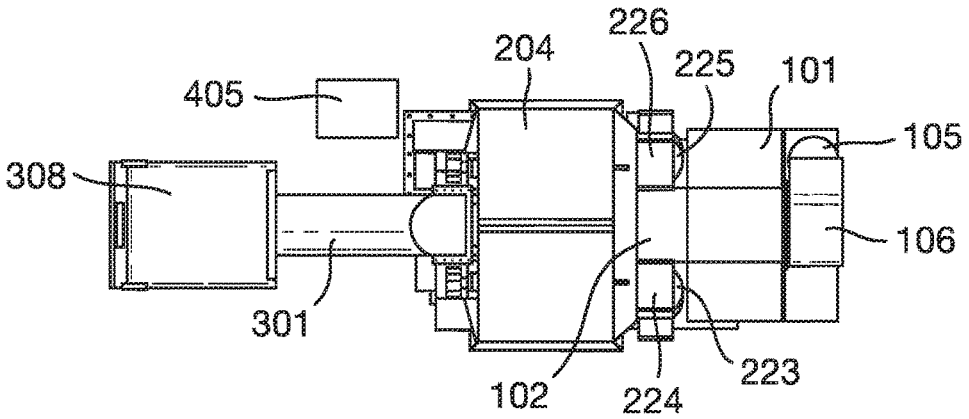
FIG. 3 is a bottom view of the system of FIG. 1.
Figure 4:
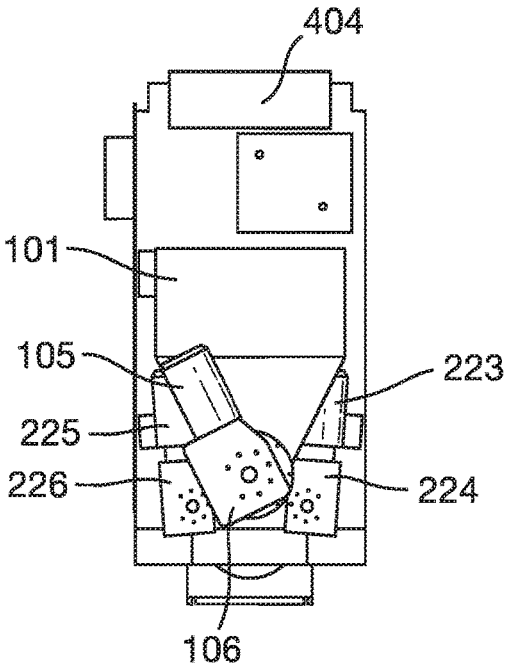
FIG. 4 is an end view from said one end of the system of FIG. 1.
Figure 5:
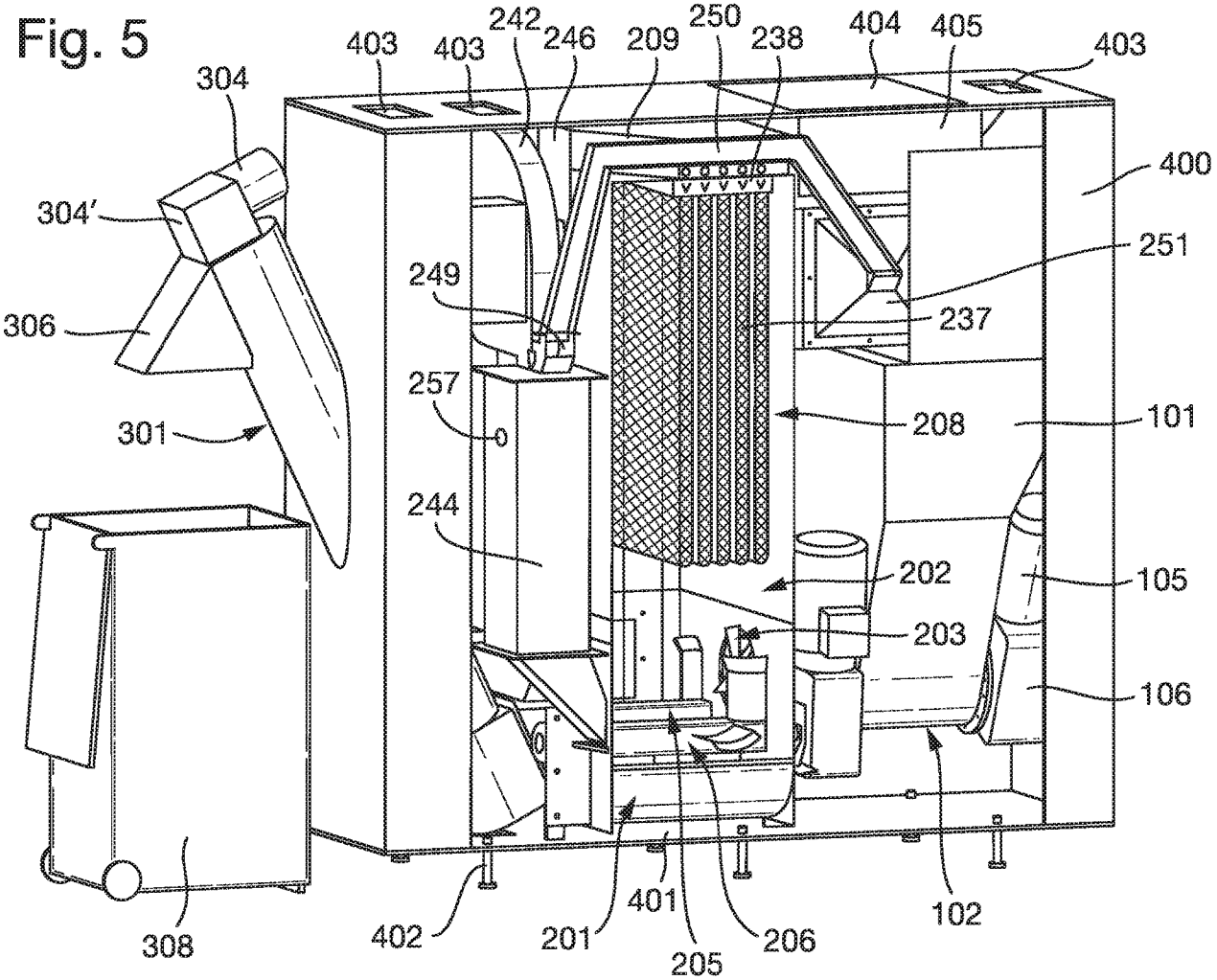
FIG. 5 is a schematic perspective view of the system as seen from said one side thereof, with some cover panels removed for sake of clarity.

As indicated on FIG. 2, the system essentially comprises three major modules, such as a feed-in and shredder module 100, a fluidizer and dryer module 200, and a feed-out module 300. Although not shown on FIGS. 1-4, these modules could have a protective and surrounding housing 400, as indicated on FIGS. 5 and 6 where parts of the housing have been removed for sake of clarity and viewing of structural devices inside the housing.

In order to avoid any smell from the inside of the housing, a pressure therein below atmospheric pressure can be provided to avoid any smell in particular from modules 100 and 300, but also from module 200. Any smell within the housing can easily be ventilated out of a building where the system is installed and to the atmosphere. The process itself, in particular when using superheated steam as the drying agent, will reduce odours and bad smells when drying smelly products, and due to condensing of vapour a non-odour process is possible to achieve. Downstream processing treatment of the condensate is then also, by volume, treating smaller amounts relative to treating and cleaning a gas fraction.

The housing has a bottom plate 401 and legs 402, and a plurality of apertures for access to and from the devices inside the housing. The housing also provides for ventilation through e.g. openings 403 in a top surface, as indicated on FIG. 5. The box 404 shown on FIGS. 1, 2, 4-6 typically denotes a box for displays, control panels and operational monitor outputs, as well as e.g. electronics and operation control system 405 (not shown in detail). The locations of these means are not critical and are merely mentioned as optional.

The first module has a feed-in hopper 101, and a screw conveyor 102 with a conveyor screw 103 attached to a rotary drive shaft 104, the drive shaft 104 being rotated by means of a motor 105 via a gearbox 106.

The conveyor screw 103 rotates inside a duct 107 which is curved through 180° at the bottom of the hopper 101 and inside a pipe 108 which is curved through 360° downstream of the duct 107.

Both the duct 107 and the pipe 108 have along an inside wall thereof a plurality of guide rails 109 which extend in a longitudinal direction of the conveyor, said guide rails 109 mutually being angularly spaced. The purpose of these guide rails 109 is to prevent substance(s) from rotating with wings on the conveyor screw 103 rather than being forwarded effectively to a conveyor exit. The rails 109 located in the tubular section 108 of the conveyor 102 enhance axial pressure on the substance(s) to be shredded, so that the shredding operation is optimized.

The rotary drive shaft 104 is at a downstream end thereof fixedly attached to a smaller face of a truncated cone 110 which reduces the cross-sectional open space, thereby yielding an increased internal pressure on the substance(s) to be shredded downstream, and increase the velocity of the substance(s). A high internal pressure is considered essential in case of e.g. grocery waste having cling film or plastic material wrapping in order to subsequently obtain efficient cutting of the plastic material, as it is necessary hold back the plastic material in order for parts thereof to be adequately cut.

The truncated cone 110 has along its outer face a plurality of mutually spaced straight scraper rails 111 which are provided to grind the raw material (substance(s)) at the inner zone, i.e. the zone having the least cross-sectional free area of the conveyor. If the raw material is seafood such as shells and shellfish, the grinding yields an efficient pre-fracturing thereof. The fact that the raw material is under pressure from rotating wings of the conveyor screw 103 causes an internal tearing of the raw material and thereby contributes to enhancement of the subsequent downstream shredding.

A shredding device 112 is located downstream of the conveyor screw 103 and the truncated cone 110, the shredding device enabling further fragmentation of the at least one substance before deliverance to the module 200. The shredding device comprises a set of angularly mutually spaced, stationary first knives 113 and a set of angularly mutually spaced, rotary second knives 114 downstream of the first set and in interaction therewith.

A larger face of the truncated cone 110 is attached by means of spring tensioned bolts (not shown) to an upstream face 115 of a hub 116 of the set of rotary knives 114. Spring tensioning is suitably made through using plate springs (not shown) which are compressed, the plate springs having a movement capacity of e.g. 10 mm at the end of the largest diameter of the scissors made by the knives. In case solid material, such as e.g. a stainless steel cutlery knife, is accidentally among the substances to be processed, it should be able to pass without the shredder being damaged or even destroyed. The primary task of the shredder (or scissors) is to cut the substance(s) (raw material) into multiple parts, e.g. four parts, per revolution of the set of knives 114, and enabling the cutting of e.g. bones and plastics so that a subsequent process can take place without problems in a drying zone or space or for large sheets of plastics. Large sheets of plastics may, if physically long enough, accumulate over time about drive shaft, and may possibly cause operational problems.

Figure 8:
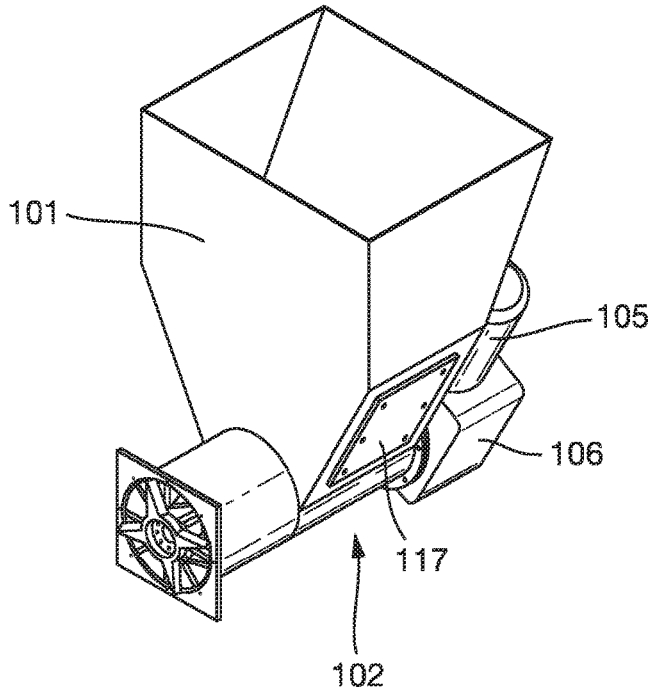
FIG. 8 is a further perspective view and from above of the first section including a modification thereof.
Figure 9:
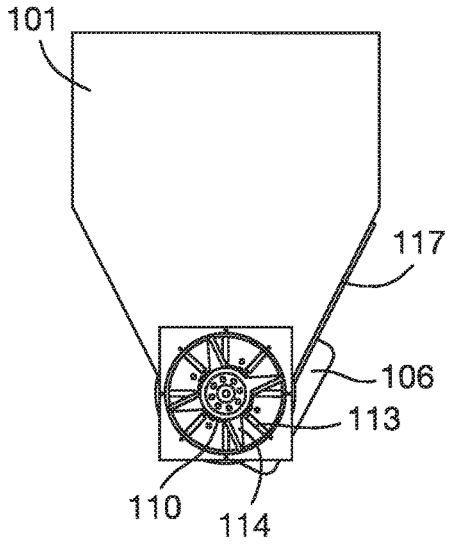
FIG. 9 is an end view of the first section as seen from a downstream end thereof.
Figure 10:
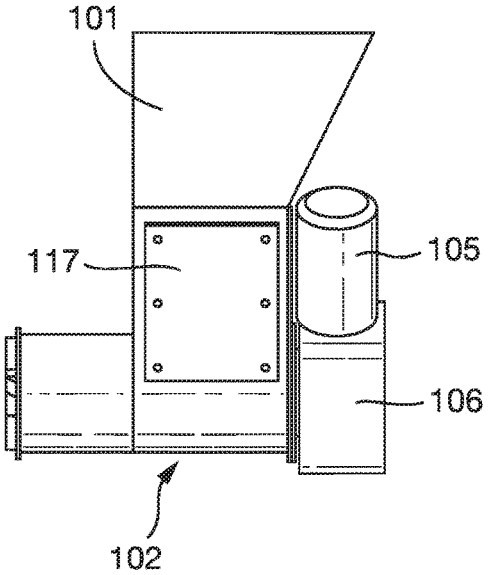
FIG. 10 is a side view of the first section as seen in FIG. 8.
Figure 11:
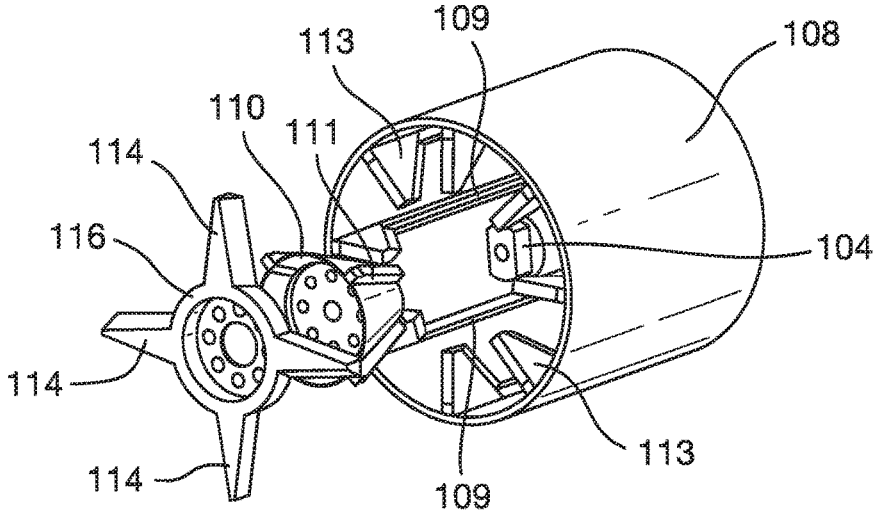
FIG. 11 is an exploded view of a downstream part of the first section of the system.
Figure 12:
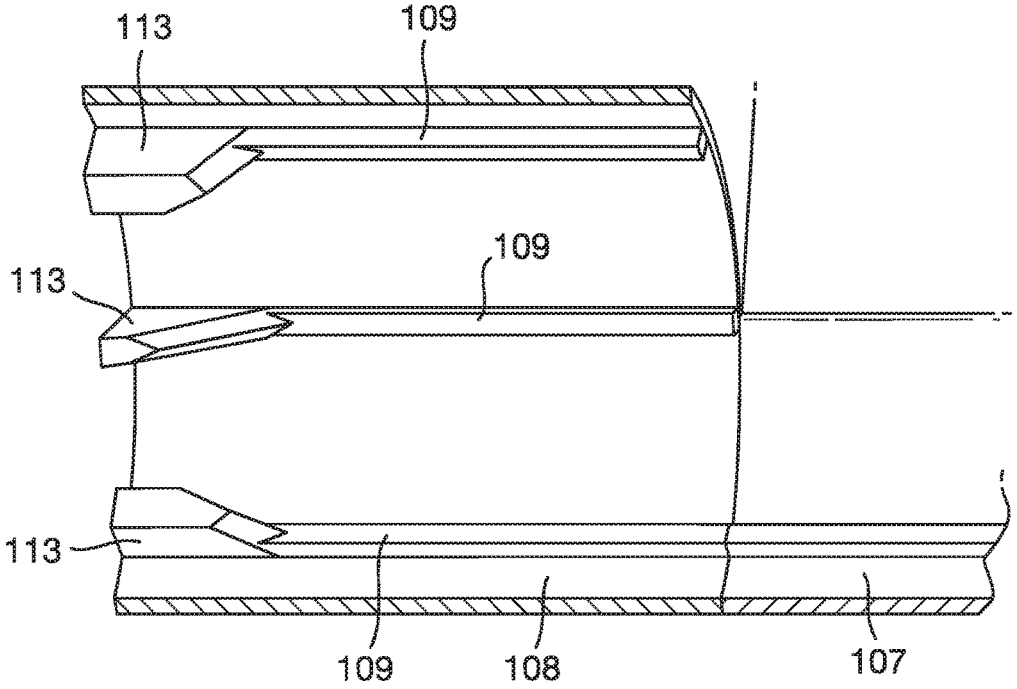
FIG. 12 is a partial view of an inside of a conveying channel of the downstream part of FIG. 11.
Figure 13:
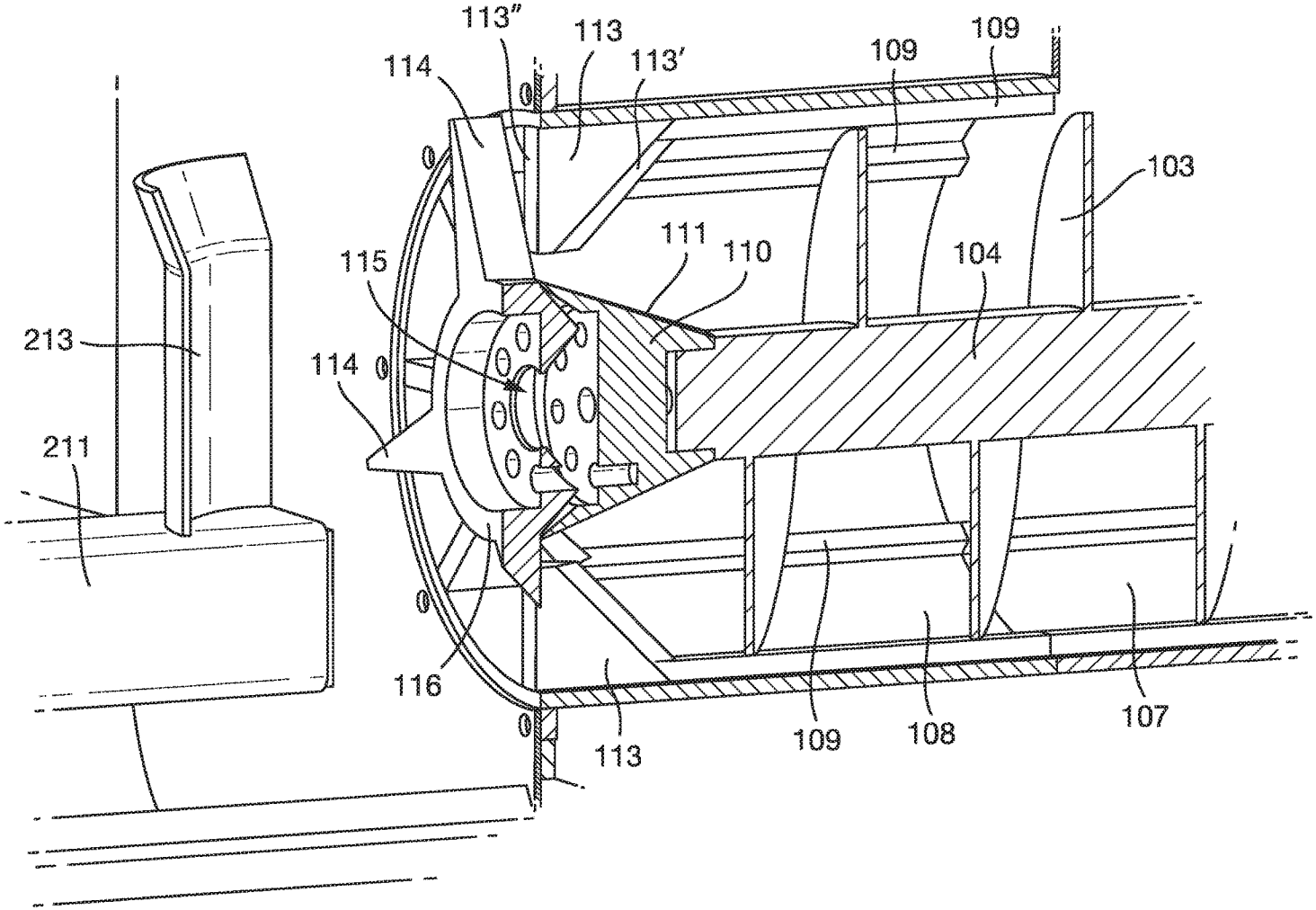
FIG. 13 is a perspective view of a half-side part of said downstream part, and to the left thereof showing a part of a second section of the system.

If unwanted materials tend to clog the module 100, the conveyor screw may be reversed and articles or objects that cannot be processed may be removed through a service gate 117 (see FIGS. 8 and 10) at a lower end of the hopper 101.

As will be noted, the knives 114 cut against and along the downstream end of the knives 113. The knives 113 which are welded to the inside of the tube 108 are angled outwardly in the downstream direction, yielding that if e.g. a plastic carrier bag accompanies the substance(s) downstream axially at the outer part of the tube 108, e.g. at its maximum diameter, it will then be forced inwardly into the raw material (substance(s)) towards the truncated cone and towards the narrowest cross-sectional area, i.e. yielding that it meets a massive resistance force from the remaining raw material or substance(s) and will be cut together with that raw material.

It should be observed that e.g. sheets of plastics or plastic foil or any other potentially problematic material to be processed in the present context are considered as one of the at least one substance to be processed.

It will be noted that the stationary knives 113 of the shredding device have an upstream region which is configured as an inclined or stepped sharp edge 113', and wherein a downstream region 113" of the stationary knives has a cutting face being parallel to an upstream face of the rotary knives 114. The cutting edge is suitable as a raw material preliminary divider. Each stationary knife 113, as seen in the longitudinal direction of the conveyor, has its longest dimension where it is attached to the inside tube wall 108 of the conveyor 102. Further, it is noted that the guide rail 109 at its downstream end joins the upstream end 113' of the stationary knife 113 adjacent the wall of the tube 108. However, there may be more knives 113 present than a number of guide rails 109 to join them.

A downstream end of the conveying screw 103 of the conveyor 102 is spaced from an upstream face 115 of the hub 116 of said rotary knives 114. In fact, the screw 103 preferably also ends short of the location of the stationary knives 113. A longitudinal small space has thus no conveyor screw present and constitutes a volume having no influence other than receiving raw material or substance(s) to be processed and which is pushed to the space by use of the conveyor screw.

This temporary accumulation of raw material/substance(s) at said small space yields a kind of "plug" of the raw material prior to its shredding by the interacting knives 113, 114 and will yield a high internal pressure which prevents or diminishes upstream leakage of materials and drying agent from the fluidizing and drying module 200 into module 100.

The knives 113 and 114 effectively form a plurality of scissors. The number of knives 113 is in the embodiment shown as being eight, and the number of knives 114 is in the embodiment shown to be four. The number of knives is not critical, and the number of knives shown are the currently preferred ones. To a large extent the number of knives will greatly depend on the type of substance(s) to be processed. The number of knives shown is thus just a non-limiting example.

When there is no more raw material or substance(s) to be processed, the "plug" will gradually dry from within and eventually collapse because the material thereof noticeably shrinks when dried out. The drying sequence in module 200 may then be safely stopped without any risk of decomposition of the waste or raw material being in that region of the system.

The control system 405 inside the box 404 will at such a time detect from temperature sensors associated with module 200 that there is too little water or humidity in the drying process performed by module 200, yielding an increased exhaust temperature from a drying and fluidizing space of module 200, and module 200 may then suitably enter into an idle mode state with a low maintenance temperature within that space, e.g. 50-100° C., and for a limited period of time.

The invention is now to be further described with regard to the second module 200.

Essentially, the module comprises a fluidizing, drying, filtering and condensing unit 201 which is configured to receive in a space 202 thereof said at least one substance in fragmented or shredded state at a first input 203 thereof. The unit 201 has a lower region 204 with at least two sets of rotary shovels 205, 206 located in said space 202. At least one second input 207, e.g. at a lower region 204 of the space 202 is configured to receive drying agent, e.g. hot gas, hot air, vapour or superheated steam for injection into the substance(s) present in the fluidizing and drying space 202 of the unit, subjecting the at least one fragmented substance to fluidizing action from said sets 205, 206 of shovels. The drying agent entering the space may suitably be at atmospheric pressure propelled into the space 202 by a fan 240. A filtering unit 208 is located in said space 202 spaced above said at least two sets 205, 206 of rotary shovels. Drying agent exit means 209 forming a "clean zone" is located in communication with the filtering unit 208 at an upper end of said space 202 allow exit flow of used drying agent, e.g. gas, vapour, steam, superheated steam or air, having passed through the fluidized substance(s) to exit said space 202 and thereby containing any fraction of humidity collected from the substance(s). Further, the fragmented, fluidized and dried substance(s) can be caused to leave said space 202 at a lower region thereof as an end product, suitably through an outlet 210.

The at least two sets 205, 206 of rotary shovels have respective rotary shafts 211, 212 with their rotary axes in parallel, and rotate in a first mutually counter-rotating mode when operating to fluidize the fragmented substance(s). The shovels 213-216 and 217-220 extend radially from their respective shaft 211 and 212, as clearly shown on FIGS. 18, 19*a*-19*c* and 20*a*-20*c*.

The shovels 213-217; 218-222 of each set 205; 206 of shovels extend radially from a respective surface of the respective common rotary shaft 221; 212.

Each shovel, as viewed radially from the rotary shaft, has a curved cross-section to present upon rotation of the set of shovels a convex surface, e.g. 213' and 218' to face the fragmented substance(s) to be fluidized. Each shovel at a radially outer region, e.g. as shown at 213" and 218", is forwardly flared in a direction of a fluidizing mode of rotation, the outer region thereby having a forward face forming an angle with the rotary forwardly facing convex surface, e.g. 213' and 218', of the remainder of the shovel. The angle will be a function of the material(s) to be processed, but often being larger than 90° and less than 180°, preferably between 120° and 150°.

The shafts 211 and 212 have ends 211" and 212" which are linked to drive motors and gear boxes 223, 224 and 225, 226, see FIGS. 1-4.

Figure 21:
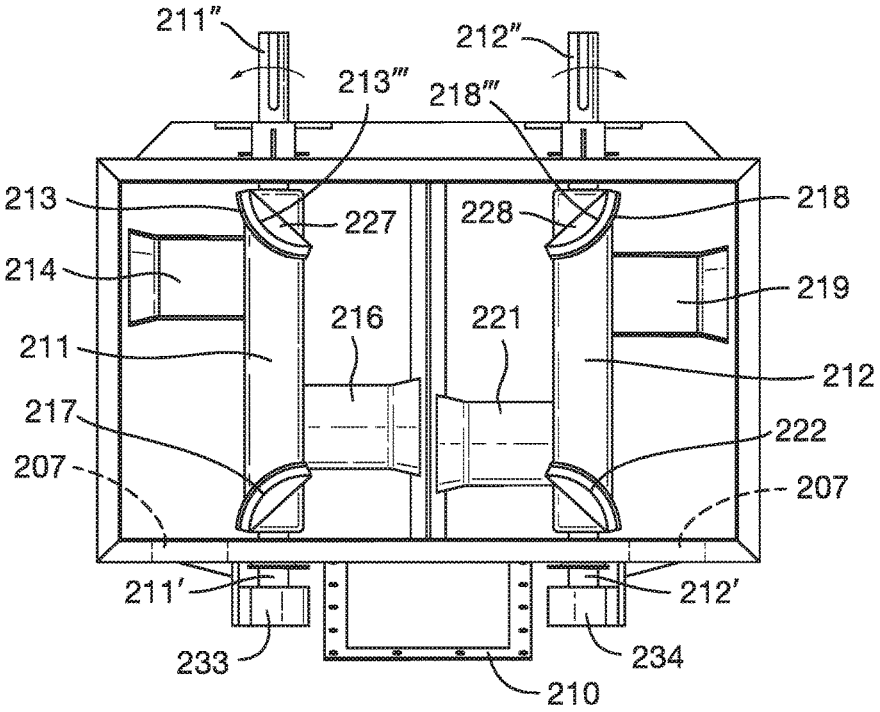
FIG. 21 is a view from above of the lower region of the second section with a first alternative of first and second counter-rotating sets of shovels.
Figure 22:
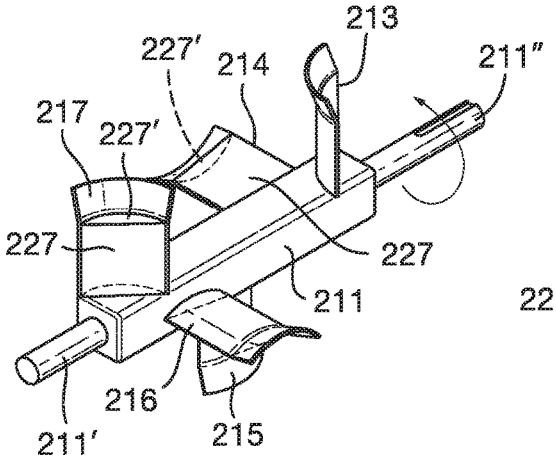
FIG. 22 is a perspective view of the first alternative of the first set of rotary shovels of said lower region of the second section.
Figure 23:
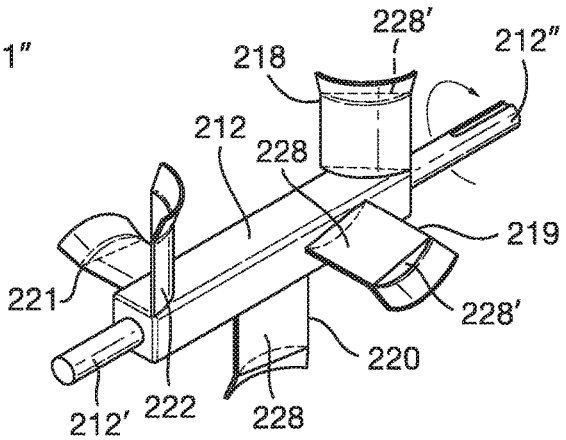
FIG. 23 is a perspective view of the first alternative of the second set of rotary shovels of said lower region of the second section.

In the embodiment shown FIGS. 21-23, the concave side, e.g. 213''' and 218''' of the shovel between said outer region and the respective surface of the shaft is covered by a rear plate member 227, 228 extending between side edges of e.g. the shovels 213, 218. The plate member may suitably be flat, but could instead be curved. These plates are more visible from viewing shovels 214, 217 and 219, 220 on FIGS. 22 and 23, respectively. It will be noted that a space thus being present between said concave side and the plate member is closed off at a first and second radial edge region of the plate member to yield a sealed cavity. On FIGS. 22 and 23 it will be noted that at the radially outermost end of the plate member 227; 228 there is provided a closing member 227'; 228', whereas at the radially innermost end the cavity is substantially closed by means of the respective shafts 211; 212.

Although not shown on FIGS. 21-23, it could be contemplated to let the closing member 227'; 228' extend all the way up from the radially outmost edge of the plate member to the most radially edge region of the shovel, i.e. at the edge region of the forwardly flared part of the shovel. This will generally be a matter of choice, depending on the type of fragmented substance(s) to be processed.

Figure 30A:
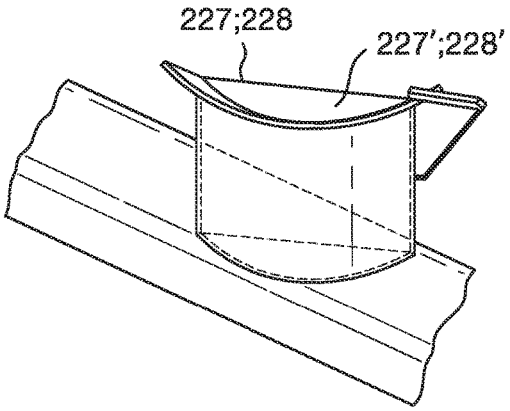
FIG. 30 is a perspective view from above of a fourth type of shovel useable with the two set sets of shovels.
Figure 30B:
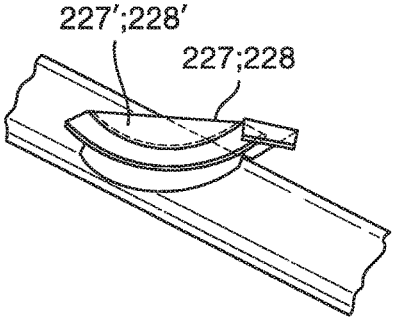
Figure 30C:
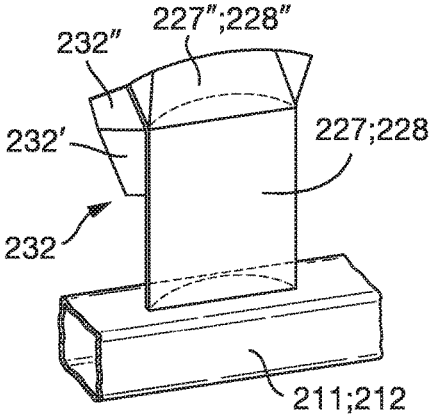
Figure 31:
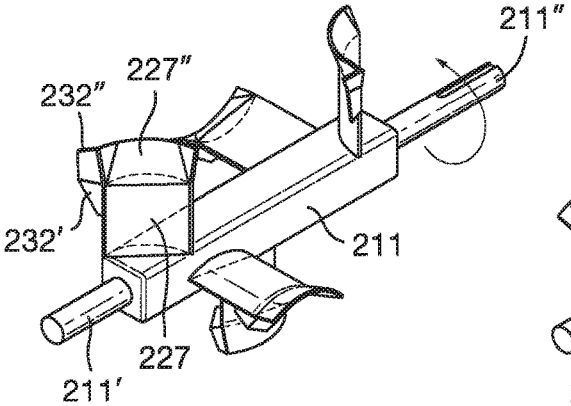
FIG. 31 is a perspective view of a fourth alternative of the first set of rotary shovels of said lower region of the second section, using a shovel type according to FIG. 30.
Figure 32:
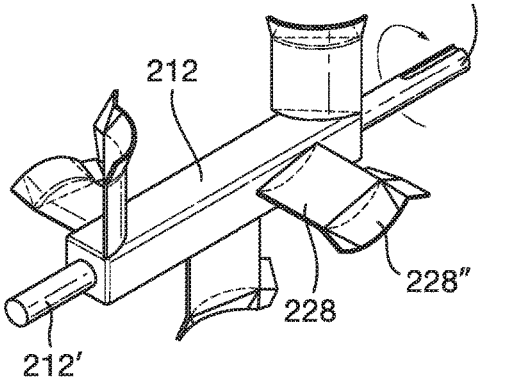
FIG. 32 is a perspective view of a fourth alternative of the second set of rotary shovels of said lower region of the second section, using a shovel type according to FIG. 30.
Figure 33A:
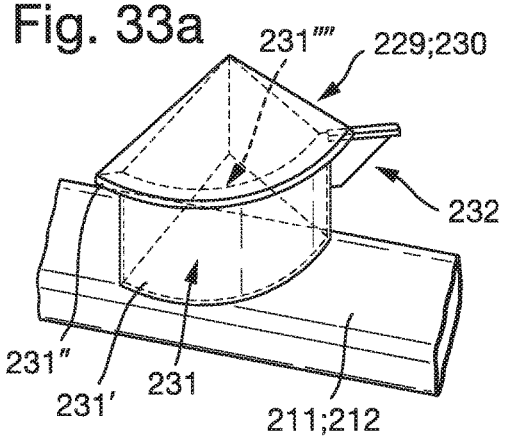
FIG. 33 is a perspective view from above of a fifth type of shovel useable with the two set sets of shovels.
Figure 33B:
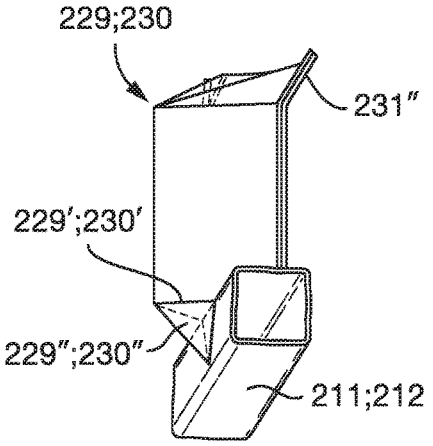
Figure 33C:
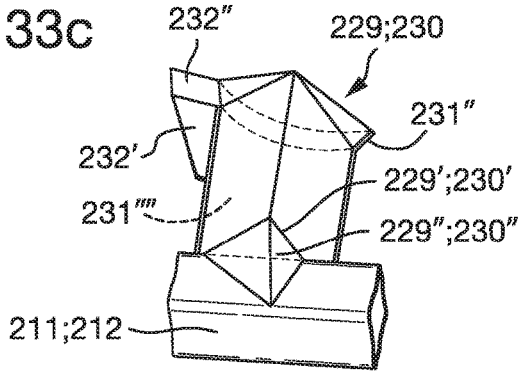
Figure 34:
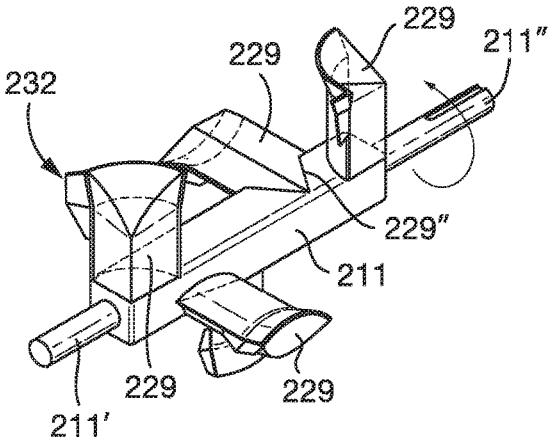
FIG. 34 is a perspective view of a fifth alternative of the first set of rotary shovels of said lower region of the second section, using a shovel type according to FIG. 33.
Figure 35:
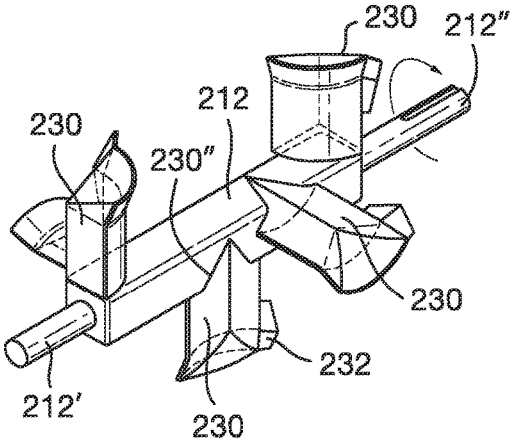
FIG. 35 is a perspective view of a fifth alternative of the second set of rotary shovels of said lower region of the second section, using a shovel type according to FIG. 33.
Figure 36:
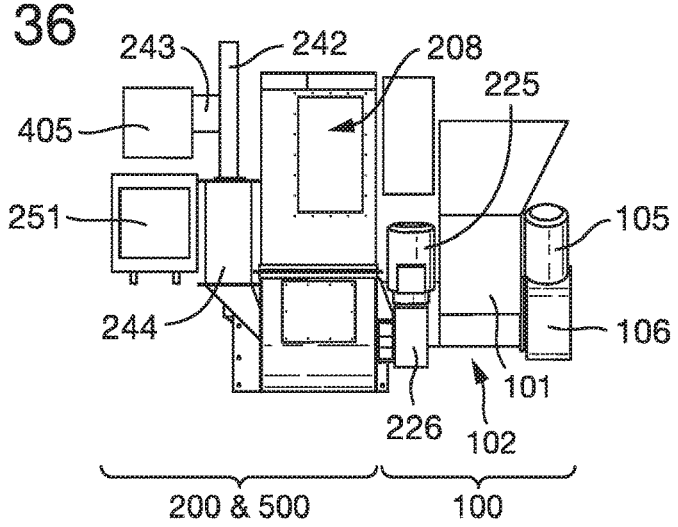
FIG. 36 is a side view of a modified embodiment of the system as shown on FIG. 2.
Figure 37:
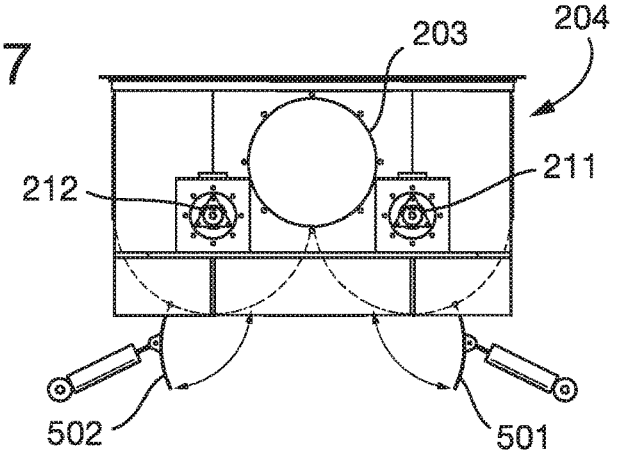
FIG. 37 is an upstream end view of a modified lower region of a second section of the system and with a modified third section for outputting processed, fragmented substance(s).
Figure 38:
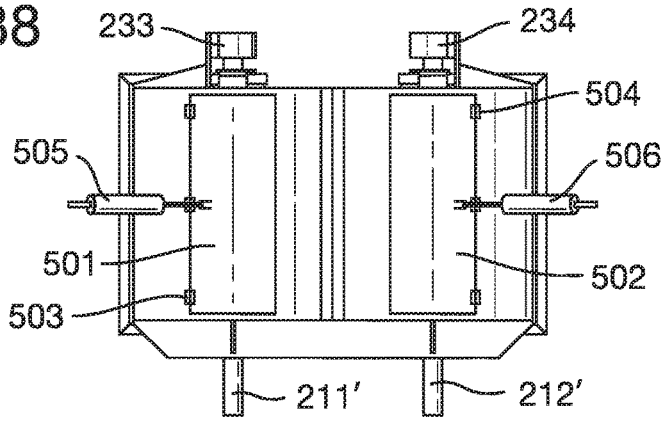
FIG. 38 is a bottom view of the lower region as shown on FIG. 37.
Figure 39:
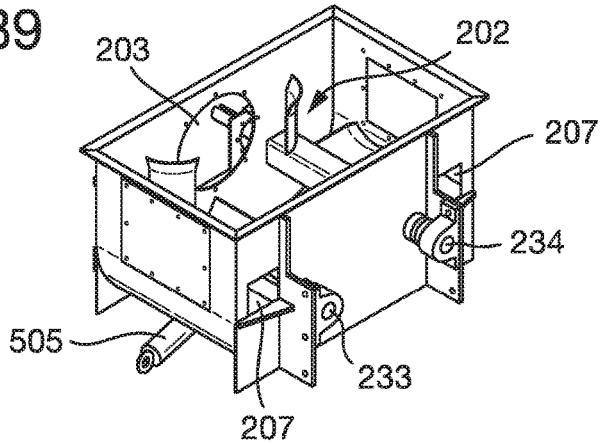
FIG. 39 is a perspective view from above of the modified lower region of a second section.
Figure 40:
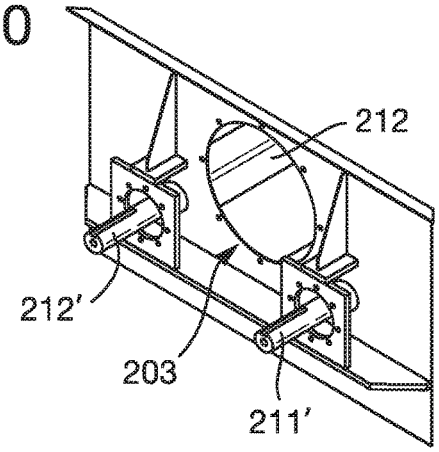
FIG. 40 is a perspective view of an upstream end of a lower region of a second section.
Figure 41:
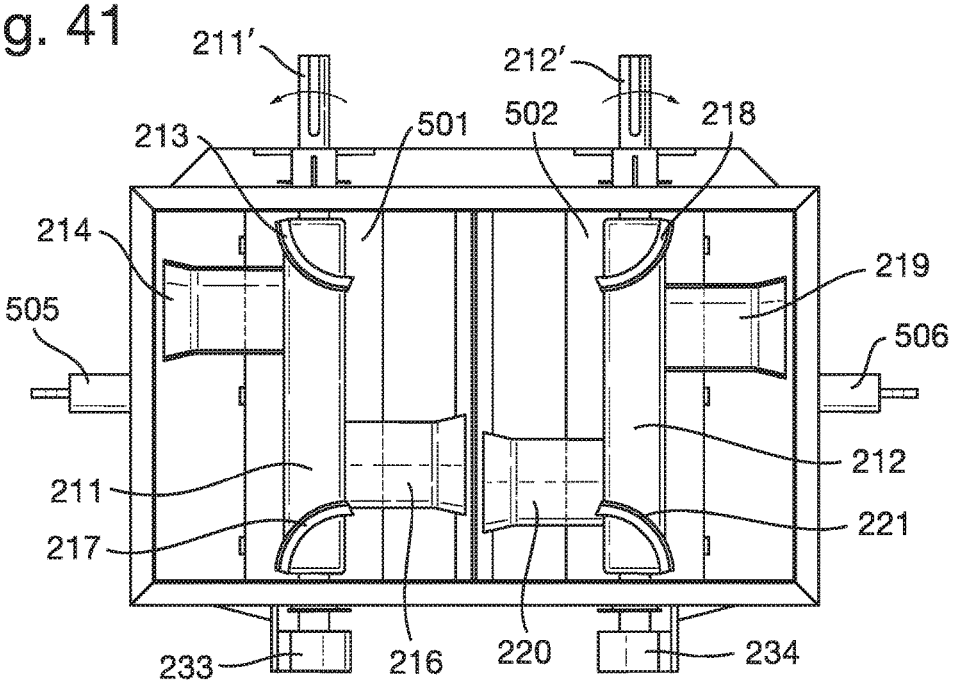
FIG. 41 is view from above of the modified lower region of a second section.

In connection with the further improved embodiment as shown on FIGS. **30*a*-30*c*, 31 and 32 such "all the way up" closure member 227"; 228" is shown in detail on FIGS. 30*c*, 31 and 32**.

Figure 18:
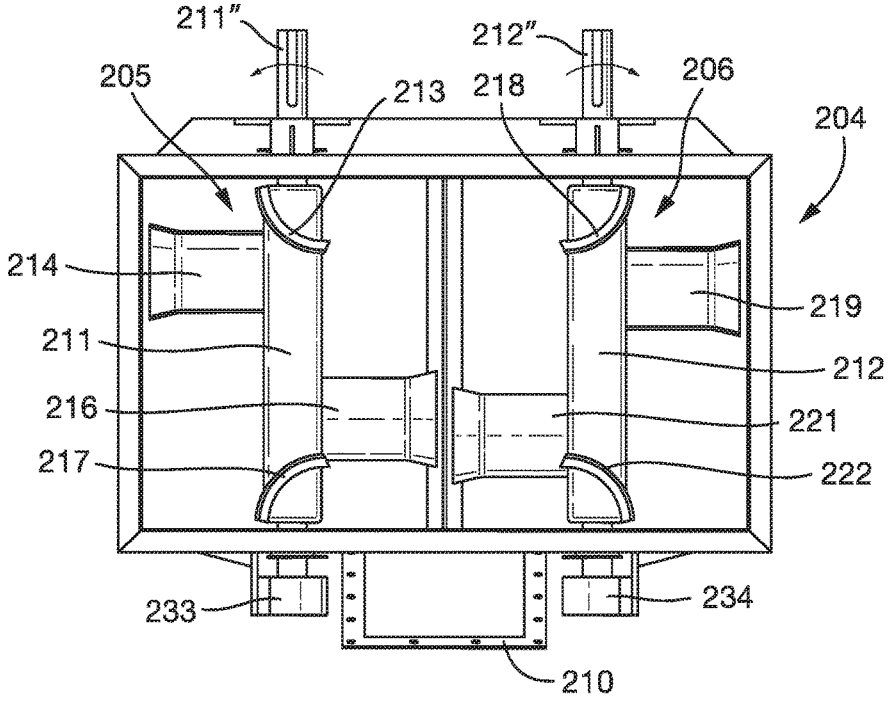
FIG. 18 is a view from above of the lower region of the second section with first and second counter-rotating sets of shovels.
Figure 19A:
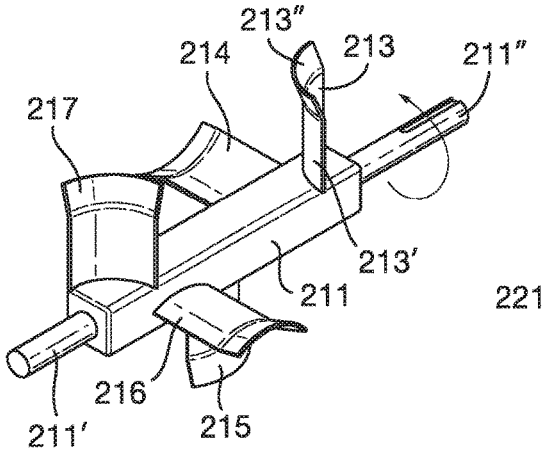
FIG. 19*a* is a perspective view of a first set of rotary shovels of said lower region of the second section.
Figure 20A:
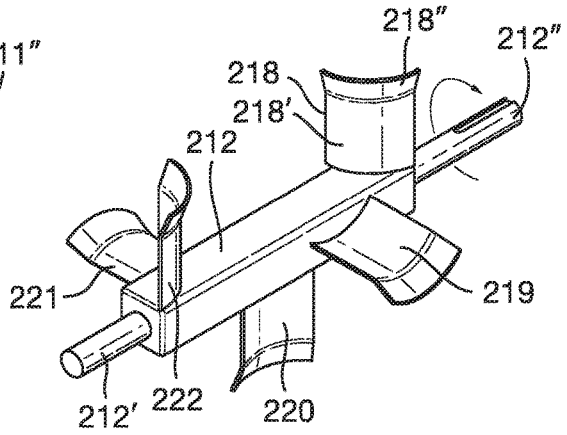
FIG. 20*a* is a perspective view of a second set of rotary shovels of said lower region of the second section.
Figure 19B:
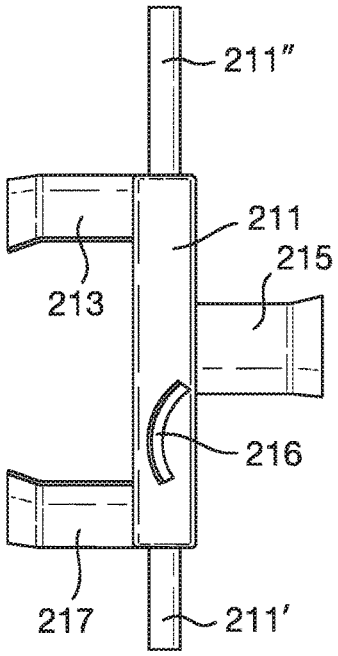
FIG. 19*b* is a view from above of the first set rotated through 90° relative to the view of FIG. 19*a*.
Figure 19C:
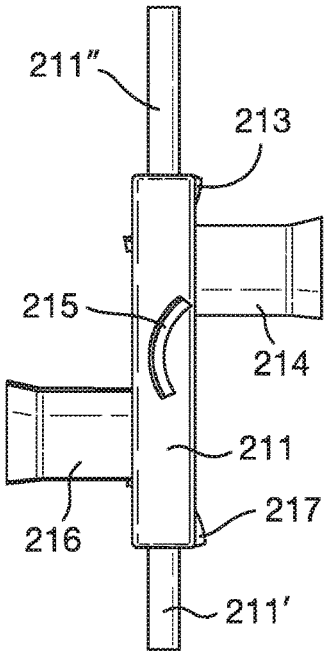
FIG. 19*c* is a view from above of the first set rotated through 90° relative to the view of FIG. 19*b*.
Figure 20B:
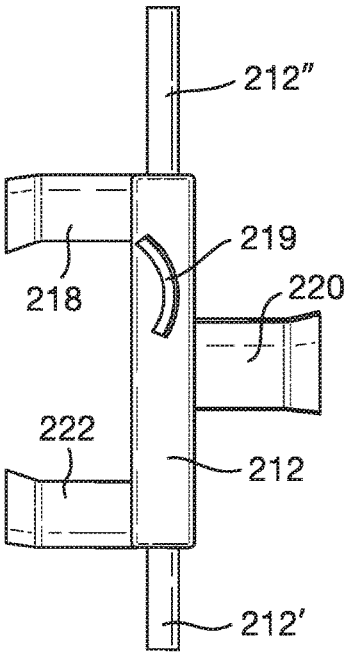
FIG. 20*b* is a view from above of the second set rotated through 270° relative to the view of FIG. 20*a*.
Figure 20C:
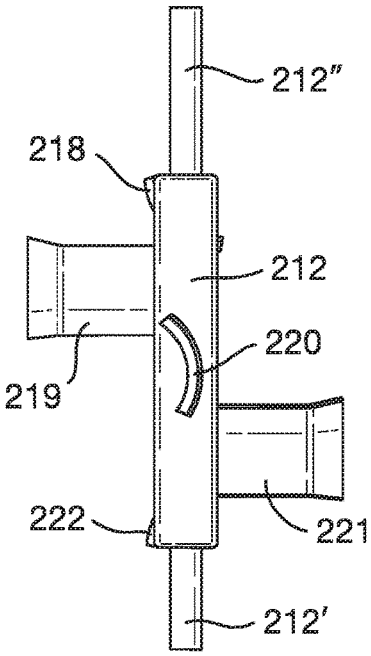
FIG. 20*c* is a view from above of the first set of rotary shovels rotated through 180° relative to the view of FIG. 20*a*.

The directions of rotation of the at least two sets 205, 206 of shovels could be mutually reversed upon a phase of operation causing the end product to leave the space 202, thereby yielding a second mutually counter-rotating mode, i.e. a mode of rotation opposite to that shown on FIGS. 18 and 21.

Figure 24:
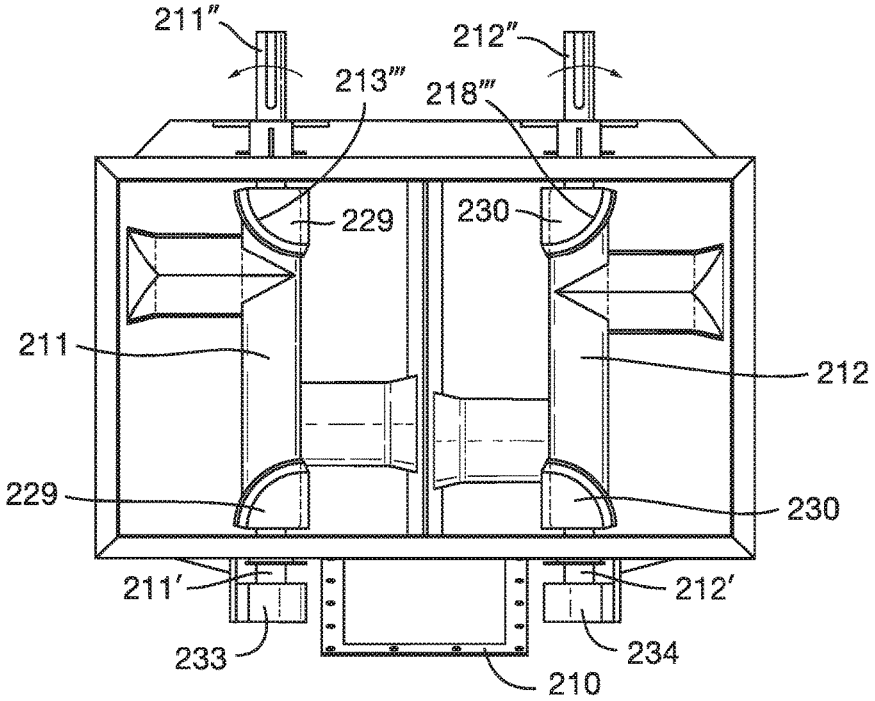
FIG. 24 is a view from above of the lower region of the second section with a second alternative of first and second counter-rotating sets of shovels.
Figure 25:
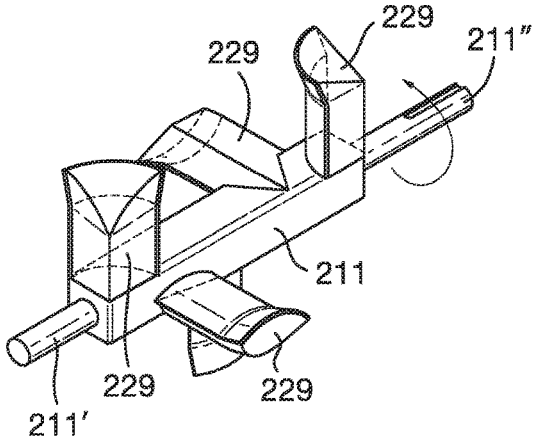
FIG. 25 is a perspective view of the second alternative of the first set of rotary shovels of said lower region of the second section.
Figure 26:
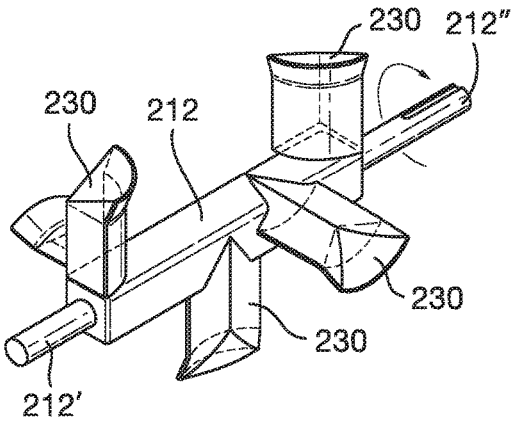
FIG. 26 is a perspective view of the second alternative of the second set of rotary shovels of said lower region of the second section.

Suitably, upon feed-out, first the set 205 rotates in a direction opposite that shown on FIGS. 18, 21 and 24, and then the second set 206 rotates in a direction opposite that shown on FIGS. 18, 21 and 24. It is also possible to let the sets rotate in this manner simultaneously or at different rotational speeds.

The advantage of the plates 227 and 228 is that they enhance the feed-out from the lower region 204 of unit 201. If the shovels do not exhibit such rear plates 227, 228, then it may be necessary to have conveyor means from the lower region 204 protruding more into the outlet region 210 than would normally be required, and in addition let the conveyor have less inclination that normally required.

Further, the rear plate member 227; 228 and the closing member 227'; 228' prevent on the rear (concave) side of the shovel an unwanted build-up of substance(s) if they are of a powder type or a finely divided material, as will be further discussed below.

The rear plates 227; 228 may be of a slightly flexible type such as e.g. of a material known as Viton® or may have a non-stick coating such as e.g. Teflon®.

In order to enhance fluidization properties for certain types of fragmented substance(s) to be processed, an aerodynamic member 229; 230, e.g. having a drop shaped or wedge shaped configuration and which extends rearwards from the concave side, e.g. 213''' and 218''', of the shovel. The aerodynamic member 229; 230 has its widest dimension closest to said concave surface. Like the previously described and shown plate and closure members 227, 227' and 228, 228', the aerodynamic member prevents build-up of particle-"cakes" and a situation with a product mixture having non-consistent composition. The top and bottom of the member 229; 230 will be closed, so that the member in co-operation with the concave side of the shovel constitutes a closed cavity. The aerodynamic member may be of a slightly flexible type such as e.g. of a material known as Viton® or may have a non-stick coating such as e.g. Teflon®. It could be made of a rigid material if e.g. provided with as non-stick coating.

Such rear plate member 227; 228 or aerodynamic member 229; 230 may be particularly suitable for use in the case that the substances to be processed, i.e. to be dried and fluidized, include fractions of fine particulate materials, and/or being combined with addition of liquids from low to high viscosity.

The issue of a build-up of finely divided particulate material on the rear side (concave side) of a shovel is indeed of concern when processing some specific types of material. The problem is that when such build-up of material detaches from the shovel, it will be in the form of large lumps. This must be avoided when processing such finely divided particulate material or powder type of material having air inducing powders and powders having properties of static electricity build-up or formation of crystalline bonding. Thus, with the use of a plate member 227; 228 (with closure member 227'; 228'), or with the use on an aerodynamic member 229; 230 as generally described, there will no longer be present a concave region on the shovel for build-up of such problematic material to be processed.

As shown on FIGS. 18 through 26, the shovels are located on horizontal tubular shafts 211; 212 having a square cross-section. This yields a most suitable sub-dividing of the shovels from a manufacturing point of view with shovels on each side of the square profile. In the examples shown, one side may have two shovels and the other sides just one shovel. However, this is not to be construed as a limitation of the embodiment, as there may be more shovels on either side, dependent on the axial length of the shafts 211; 212. Shovels can also be mounted diagonally, with 180° in between in each longitudinal segment, or even by every 90° for certain processes.

In order to obtain with the at least one rotary set of shovels enhanced properties as regards lifting capability on the fragmented substance(s) to be fluidized and dried or otherwise processed, both radially and tangentially, as well as obtaining an increased arc length in axial direction, a third type of shovel 231 as shown on a FIGS. **27*a*-27*c*** is provided.

Figure 14:
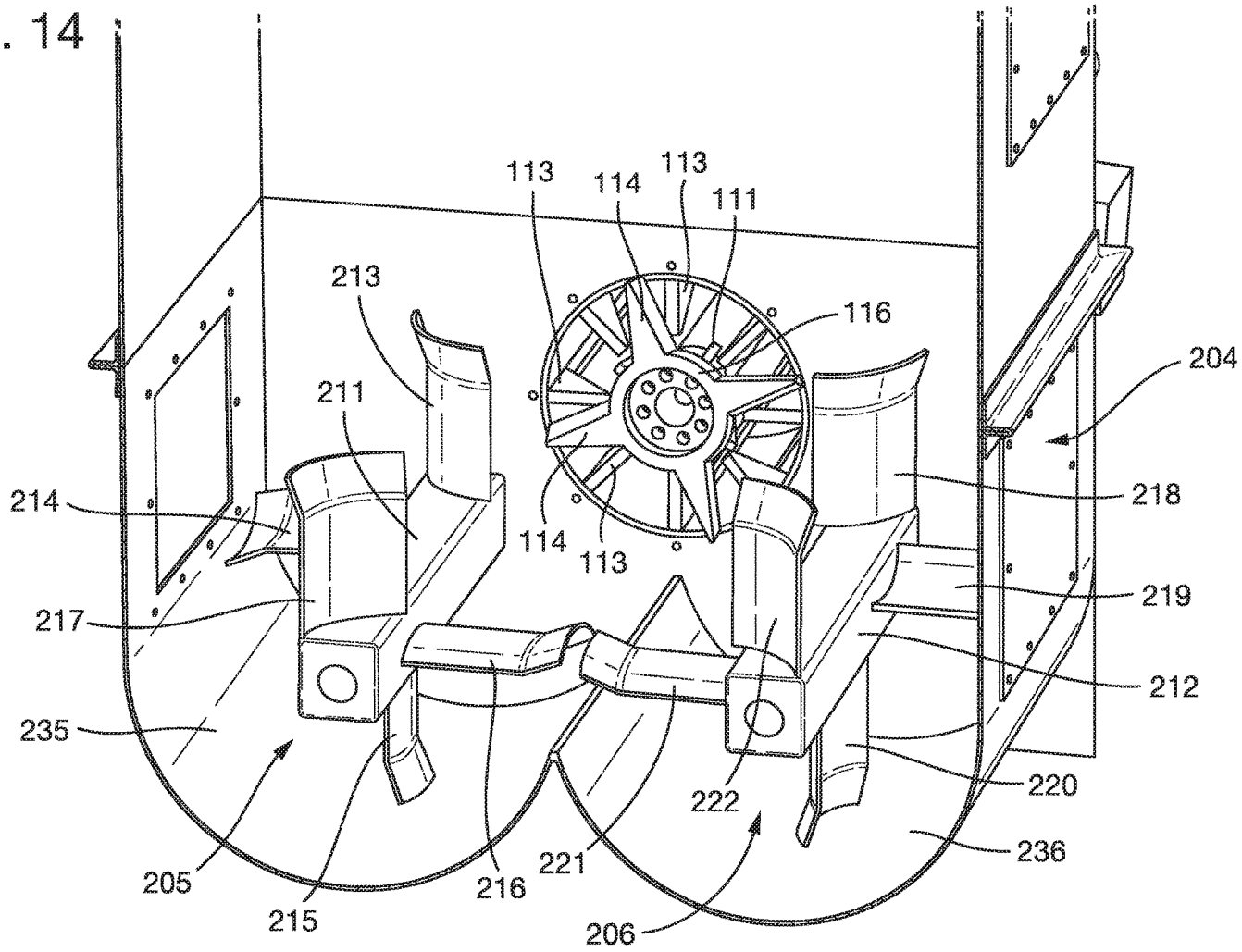
FIG. 14 is a perspective view of a downstream end of the first section as well as a perspective view of a lower region of a second section of the system, the second section providing a fluidizing and drying of said fragmented substance(s).
Figure 15:
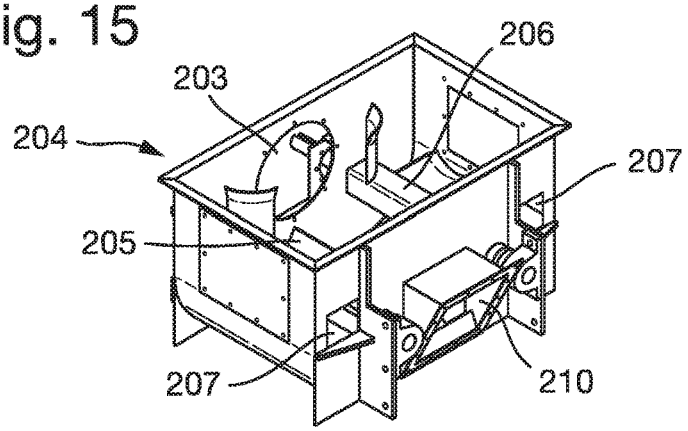
FIG. 15 is a perspective view from above of said lower region of the second section.
Figure 16:
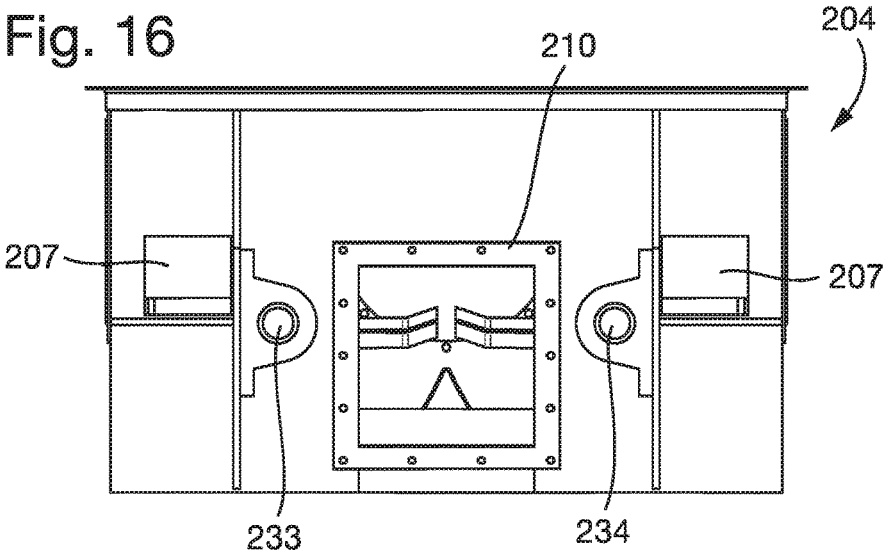
FIG. 16 is a downstream end view of the lower region of the second section.
Figure 17:
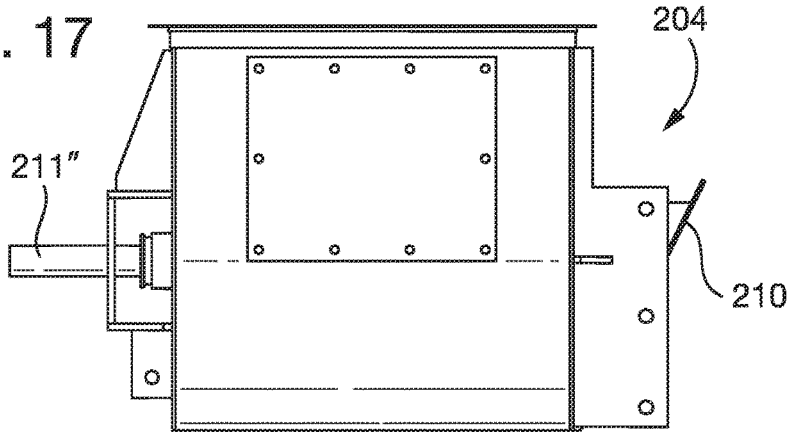
FIG. 17 is a side view of the lower region of the second section.
Figure 28:
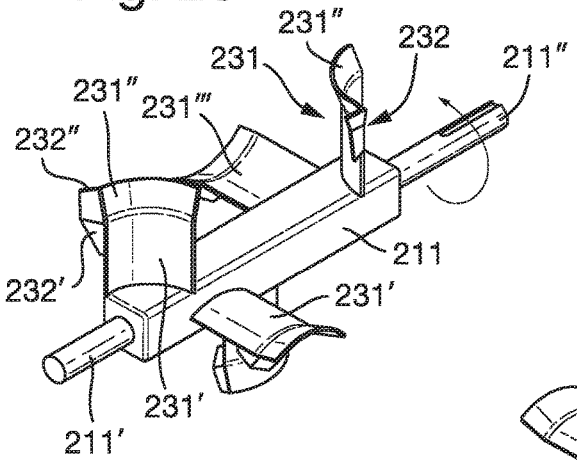
FIG. 28 is a perspective view of a third alternative of the first set of rotary shovels of said lower region of the second section, using a shovel type according to FIGS. 27*a*-27*c*.
Figure 29:
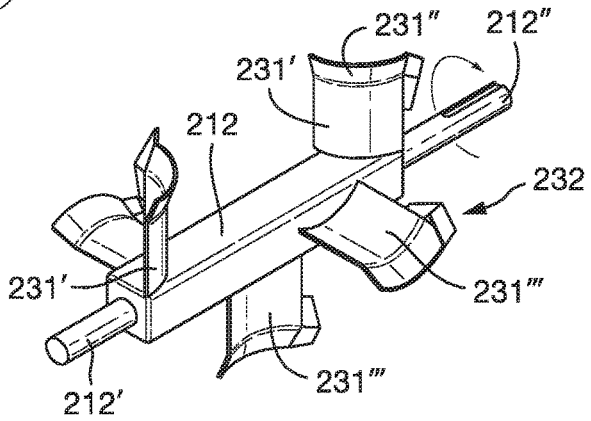
FIG. 29 is a perspective view of a third alternative of the second set of rotary shovels of said lower region of the second section, using a shovel type according to FIGS. 27*a*-27*c*.

In effect, this third type of shovel represents a modification of the shovel as shown on e.g. FIGS. 14,18, **19*a*-19*c* and 20*a*-20*c*. The shovel has a convex side 231' and is at a radially outer region 231" forwardly flared in a direction of a fluidizing mode of rotation, as indicated by the arrow, the outer region thereby having a forward face forming an angle with the rotary forwardly facing convex surface, 231' of the remainder of the shovel. Compared with the embodiment as shown on FIGS. 18, 19***a*-19*c*, 20*a*-20*c*, this third embodiment has a wing-like side member 232 at a radially extending side edge of the convex side 231' and of the region 231". The member 232 has a radially extending part 232' and a forwarded flared part 232" at a radially outer region thereof. In an embodiment of the invention, these two parts are suitably turned forwardly in the direction of rotation to form an angle with said side 231' and said region 231". The member 232 contributes to the enhanced properties as mentioned above. It will be appreciated the shovels located on a rotary shaft 211; 212, as shown on FIGS. 28 and 29, could be located in any suitable position thereon, e.g. as tentatively indicated.

The embodiments shown on FIGS. 30*a*-30*c*, 31 and 32 and FIGS. 33*a*, 33*b*, 34 and 35 are now to be described. As seen on all of the drawings, the wing-like member 232 is provided with its components 232', 232". The advantages of the member 232 have just been discussed in connection with FIGS. 27*a*-27*c*, 28 and 29, and the properties of the member 232 are the same with the further embodiments to be briefly described.

Further, as discussed in context with FIGS. 21-23 and 24-26 the issue of a build-up of finely divided particulate material on the rear side (concave side) 231'" (see FIGS. 28 and 29) of a shovel 231 is indeed of concern when processing some specific types of material. Thus, with the use of a plate member 227; 228 as (with closure member 227'; 228'), or with the use on an aerodynamic member 229; 230 as generally described, there will no longer be present a concave region on the shovel for buildup of such problematic material to be processed.

Figure 27A:
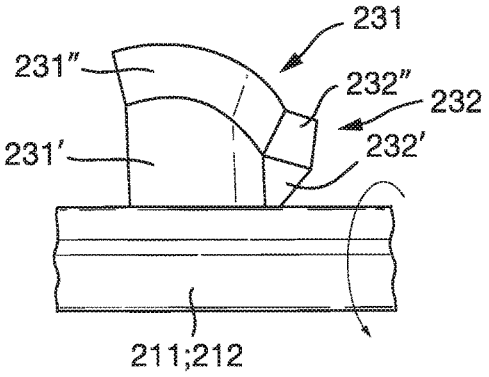
FIGS. 27*a*-27*c* are three different perspective views of a third type of shovel useable with the two set sets of shovels.
Figure 27B:
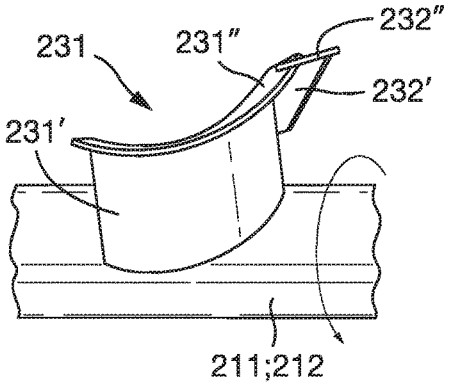
Figure 27C:
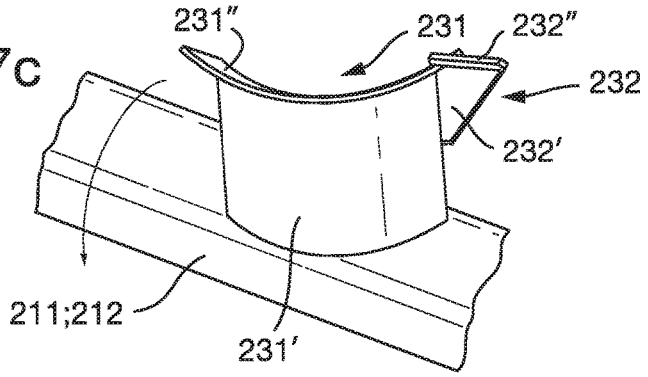

On FIGS. 30*a* and 30*b* it is noted that the closure member 227'; 228' associated with the rear plate member 227; 228 extends between the radially outmost end of member 227; 228 and the radially innermost region of the outwardly flared shovel portion 231" of the shovel 231 as shown e.g. on FIGS. 27*a*-27*c*. However, when processing powder-type materials, as discussed above, it will be advantageous to let the closing member 227'; 228' extend all the way up from the radially outmost edge of the plate member to the most radially edge region of the shovel, i.e. at the edge region of the forwardly flared part of the shovel. This will generally be a matter of choice, depending on the type of fragmented substance(s) to be processed. Thus, in connection with the further improved embodiment as shown on FIGS. 30*a*-30*c*, 31 and 32 such "all the way up" closure member 227"; 228" is shown in detail on FIGS. 30*c*, 31 and 32. Thereby, no convex face is present to cause troublesome shovel properties when handling powder-type materials. The wing-like member 232 will in addition, as mentioned before yield improved particle lifting and deployment/spreading.

FIGS. 33*a*-33*c*, 34 and 35 relate to the advantageous use of the wing-like member 232 together with the previously described advantageous properties of the aerodynamic member 229; 230. When viewing FIGS. 33*b*, 33*c*, 34 and 35, it is noted that dependent on the angle which the shovel 231 together with the member 229; 230 forms with a longitudinal axis of the rotary shaft 211; 212, a radially innermost region 229'; 230' of the member 229; 230 may project outside a longitudinal edge of the shaft 211; 212. In such a case a kind of hollow tetrahedron structure 229"; 230" may link such innermost region 229'; 230' with an adjacent side of the shaft 211; 212. The structure 229"; 230" forms obtuse angles with the shaft 211; 212, thereby avoiding that troublesome particulate material is accumulated at that region.

Although only two sets 205; 206 of shovels are shown, it would be obvious to provide further sets, if available space permits, at a location where the system is to be placed. In certain cases, it would be conceivable to use only one set of shovels or operate only one set of shovels at one time, e.g. alternately, although more than one set of shovels are provided, e.g. the two sets as currently shown on the drawings.

Using a square cross-section for the shafts 211; 212 it becomes very simple to position the respective shovels on the shafts with proper and preferred angular orientation or "twisting" relative to an axial direction of the shaft or the rectilinear sides of the shaft. A shaft with a square cross-section has also an inherent high stiffness or rigidity against twisting about and bending relative to its longitudinal axis, as well as a large circumference which may prove to be necessary to avoid any long webs or sheets or foils of e.g. plastics to become wrapped around the shafts and cause a build-up of plastics, which then could yield operational problems or at least cause reduced efficiency with regard to fluidization.

Although the shafts may have, as seen from their outside, a square cross-section, a shaft with a circular cross-section could be mounted inside the shaft of square cross-section and be fixedly attached thereto by welding, gluing, bolts or screws and be supported at one end 111'; 112' by roller bearings 233; 234 at one end and letting the other end 111"; 112" engage the respective gear boxes 224; 226 which are operated by respective motors 223; 225.

The shafts of circular cross-section when passing through the walls of the part 204 are sealed against fluid leakage to the outside by means of a packing material (not shown) riding on the circumference of the shafts thereat.

It is clearly seen from e.g. FIG. 14 that the two sets 205, 206 of rotary shovels paddle along a respective curved or semicircular floor 233; 234 of the lower region 204 of the unit 201. The radius of curvature is approximately or slightly more than a half of the diameter of rotation of each of the two sets 205 and 206. A clearance of 10-15 mm between a sweeping shovel and the floor 234; 236 may be suitable, but in cases where the substance(s) to be handled are not e.g. grocery waste, the clearance could be increased or made less. A major issue is merely to avoid that the shovels become jammed against the floor due to e.g. bones or other artifacts that could cause such jamming and even damage the shovels or overload the drive motors 223; 225 of the sets 205; 206 of shovels.

Although the drying agent, e.g. hot gas, hot air, steam or superheated steam is generally indicated to pass through the space 202 of unit 201 in the process of drying the fragmented or shredded substance(s) therein, it will be appreciated that if a gas, it could be any suitable gas or gas mixture or an inert gas. In using superheated steam, it should preferably be dry superheated steam or therein as little humidity as possible when entering the space 202. Further, the air will normally have a certain percentage of humidity, thus yielding that it could be also named as vapour.

The shovels of the dryer and fluidizing unit 201 are capable of throwing the fragmented or shredded particles of the substance(s) up into the space 202 in an ideal path of throwing, vectorized substantially upwardly directed to provide optimum energy exchange from the drying agent, e.g. hot air, longest possible engaging contact with the particles. However, in order to obtain that all raw material or shredded substances become dried in a satisfactory way, there is also an axial component related to such vectorization, typically denoted as a controlled transport pattern. This results in a combination of operational vectors which as a result yields optimal energy exchange, and thereby also provides for compact machinery in the system provided.

As indicated above, there is above the lower region located a filtering unit 208, suitably configured as a replaceable filter cassette 237 which can be inserted along rails 238 at the top of the unit 208. The filtering unit is provided to prevent fluidized particles within the space 202 from entering a loop for the drying agent which is to be de-hydrated and/or heated and re-used for drying of the particles or fragments within said space 202.

In the process of letting the drying agent, e.g. hot gas, hot air, vapour, steam or superheated steam, pass through the filter from the space 202, the outside of the filter, suitably filter bags of the filter cassette 237, will eventually become covered by dust and require cleaning. Cleaning can be made by injecting into said bags pressurized air through e.g. a shock impulse supply of pressurized air from a tank 239 via a pipeline 240 and injection nozzles 241. The filter bags of the cassette 237 have internal springs or other means to prevent the bags from collapsing during normal operation. The unit 208 has a lid (not shown) to gain access to the interior of the unit (the space 202) through an opening 245 in order to enable easy replacement of the filter cassette 237 when required.

The circulation loop consists of the filter unit 208 and its cassette 237, the clean zone 209 above the filter unit, the fan 242 powered by a motor 243 causing circulation of the drying agent, and a heater 244 heating the drying agent, such as gas, air, vapour or steam (to be superheated), to obtain a required state of dryness of the agent when it is blown into the fluidizing and drying space 202 by the fan 242. The heater 244 is suitably an electric heater, but could be a gas powered heater. The drying agent results in an evaporation of humidity or water in the shredded, fluidized material present in said space 202. The drying agent will experience a temperature fall when in a moist condition or humidified by the evaporation from the raw material in said space 202.

Figure 6:
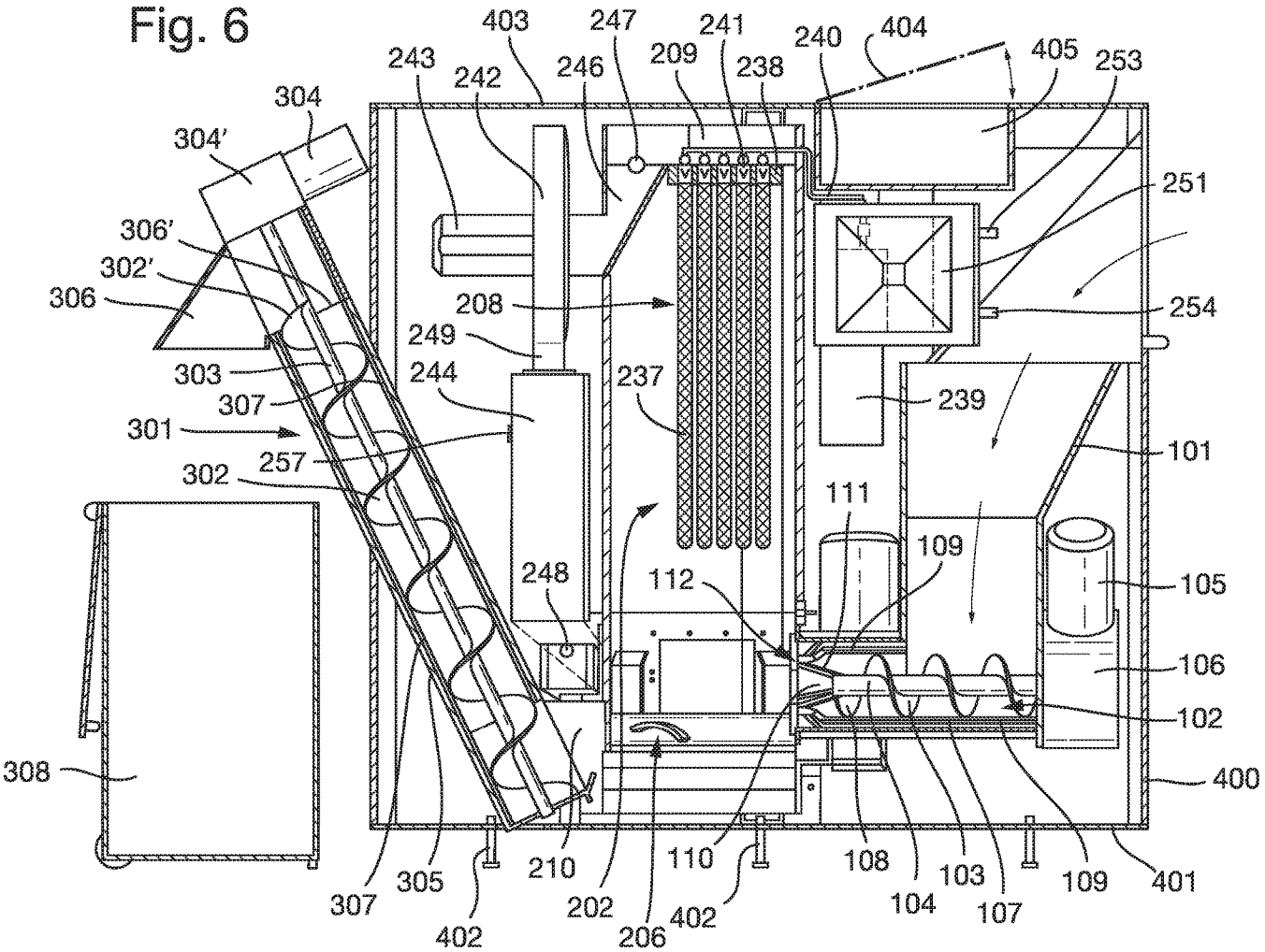
FIG. 6 is a side view of the system as seen from said one side thereof, with some cover panels removed for sake of clarity.
Figure 7:
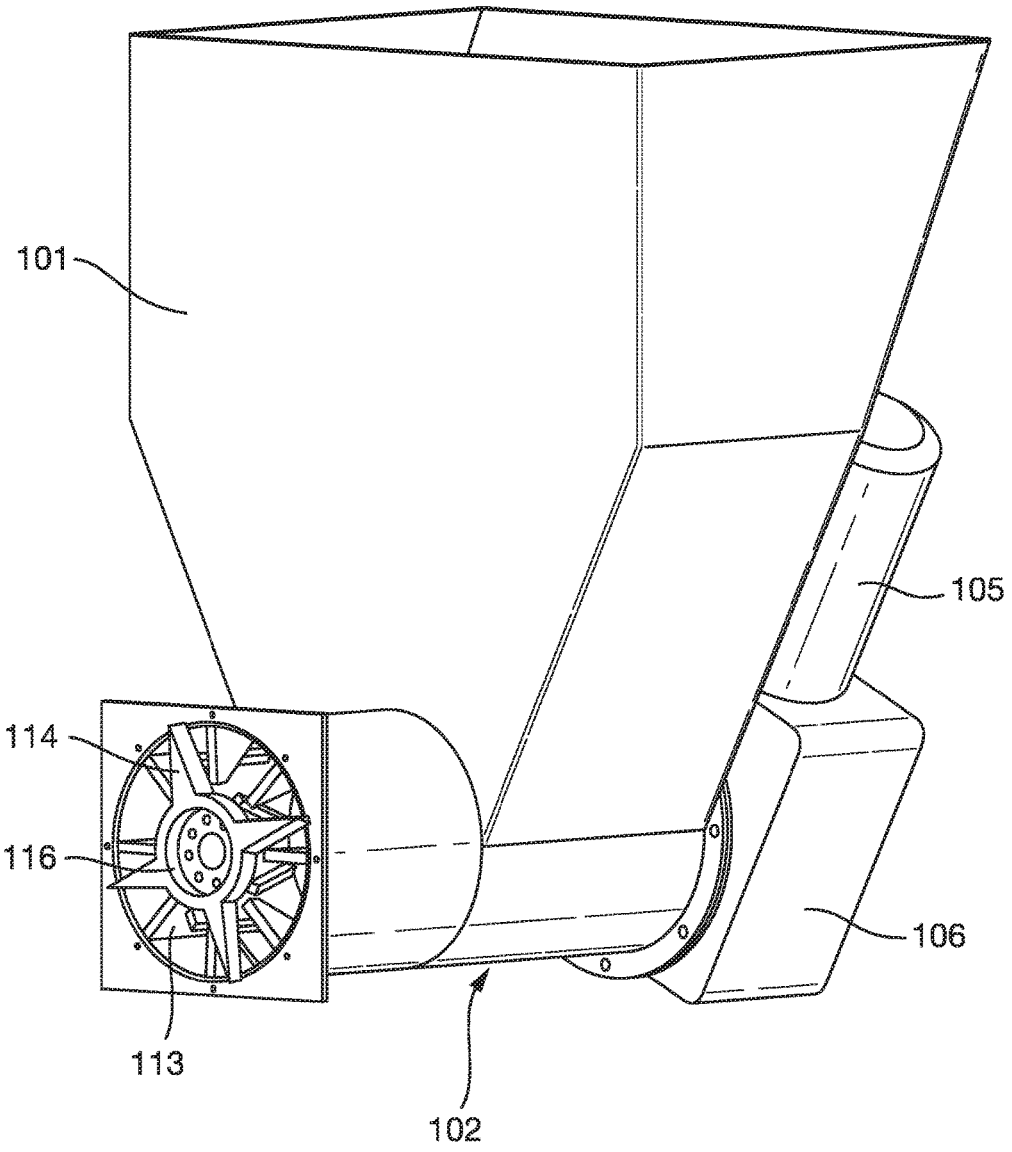
FIG. 7 is a perspective view of a first section of the system for conveying substance(s) and through use of a mill feature at a downstream end thereof delivering the substance(s) in a fragmented state.
Figure 42:
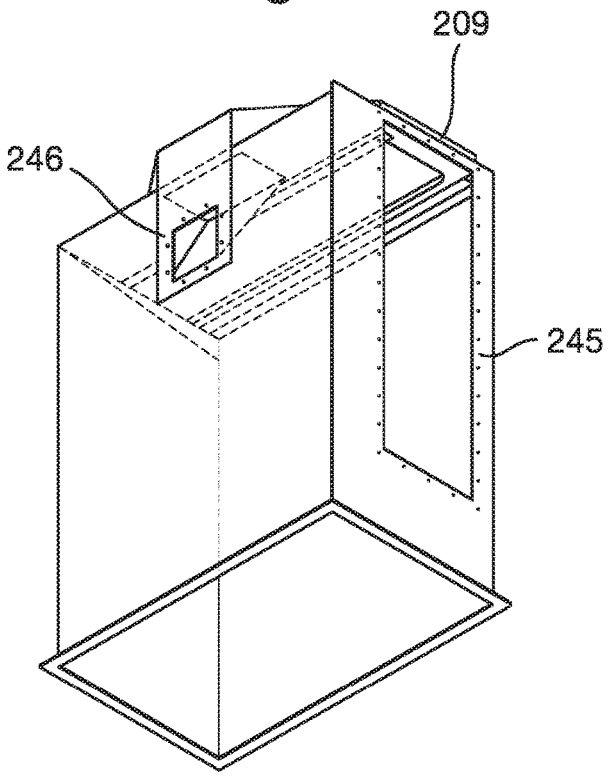
FIG. 42 is a perspective view from below of a housing for a substance particle filtering device forming part of the second section and the modified second section.
Figure 43:
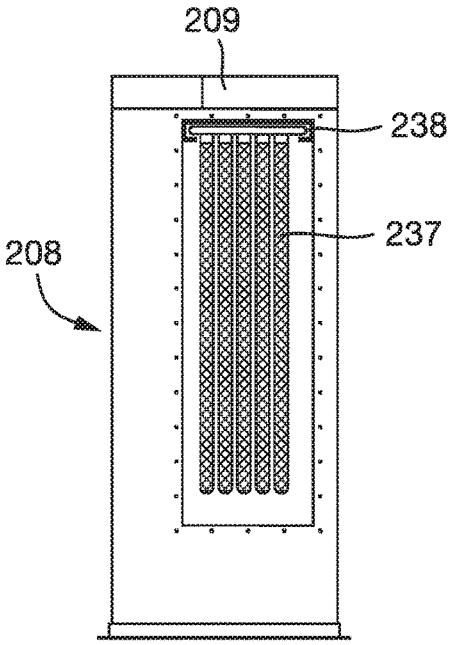
FIG. 43 is a side view of the housing of FIG. 42 and illustrating a filtering device located therein and with a closing panel on the housing removed for sake of clarity.

Passage from the zone 209 into the fan 242 is through channel 246, as seen on FIGS. 2, 6 and 42. The channel 246 is in more general terms represented by alternative pipes 260 and 262 (to be further described), as shown on FIG. 44.

The fan 242 and the heater 244 are thus provided to blow in a loop arrangement hot drying agent into said space 202 through said second input(s) 207 at the lower end thereof and causing the drying agent and any humidity added thereto from the at least one fragmented (or shredded) and fluidized substance(s) to exit the space 202 via the filter cassette 237 at the upper exit end 209 of the space by suction from the fan 242 and for further, at least partial re-entry into said space 202 through said second input(s) 207.

A drying agent property sensor 247 is located downstream of said exit end 209, the sensor 247 being capable of detecting at least one of temperature, humidity and pressure of the gas, air or vapour forming the drying agent. The sensor 247 provides a fine adjustment of the temperature of the drying agent leaving the heater 244. Also, a temperature sensor 248 is located upstream of said second input 207 for monitoring said gas or air which is to enter as drying agent the space 202 at a lower end thereof through said second input 207, i.e. downstream of the heater 244.

An adjustable drying agent flow diverting valve 249, controllable by said property sensor 247 or being manually adjustable, is suitably associated with said loop downstream of an outlet location of the fan 242 upstream of flow inlet to heater 244. Thus, if the drying agent has e.g. too much humidity, at least part of it is diverted to the heat exchanger 254. The valve 249 enables drying agent with any added humidity above a set threshold exiting said space 202 at exit end 209 and therefrom via the exit pipe 260 to the fan 242 and to the sensor 247 upstream of the heater 244 to be at least partly diverted from the loop via valve 249 and fed to the heat exchanger 251 via a pipe 250 before being fed in a de-hydrated state to the heater 244 via a pipe 256. If required, a flow booster 261 may be incorporated in the pipe 250.

As an alternative, all of humid drying agent leaving the exit end 209 may be fed via the pipe 262 directly to the heat exchanger 251, and be output from the heat exchanger 251 to the fan 242 via a pipe 263, the fan 242 thereby blowing de-hydrated drying agent DA into and through the heater 244.

Ideally the volume amount of drying agent to be diverted should be a function of the amount of vapour evaporated from the fluidized raw material/shredded substance(s). However, the diverted volume will normally be higher to yield that not too much humidity is re-entered into the drying space 202. As indicated in the alternative just mentioned, even the entire volume of drying agent may be allowed to pass through the heat exchanger 251 to obtain required de-hydration.

The flow speed from the fan 242 could be in the range 5-20 m/s (or a maximum of e.g. 0.1 $m^3$/s and/or with no limitations in volume/s for other applications), which will be sufficient to cause the evaporated moist from the raw material along with diverted drying agent to pass via a pipe 250 to a heat exchanger 251 (FIG. 5) and through the exchanger. The water present in the diverted drying agent is caused to be condensed in a conventional manner and to be delivered to a collection tray or a sewer or domestic drain 252.

Figure 44:
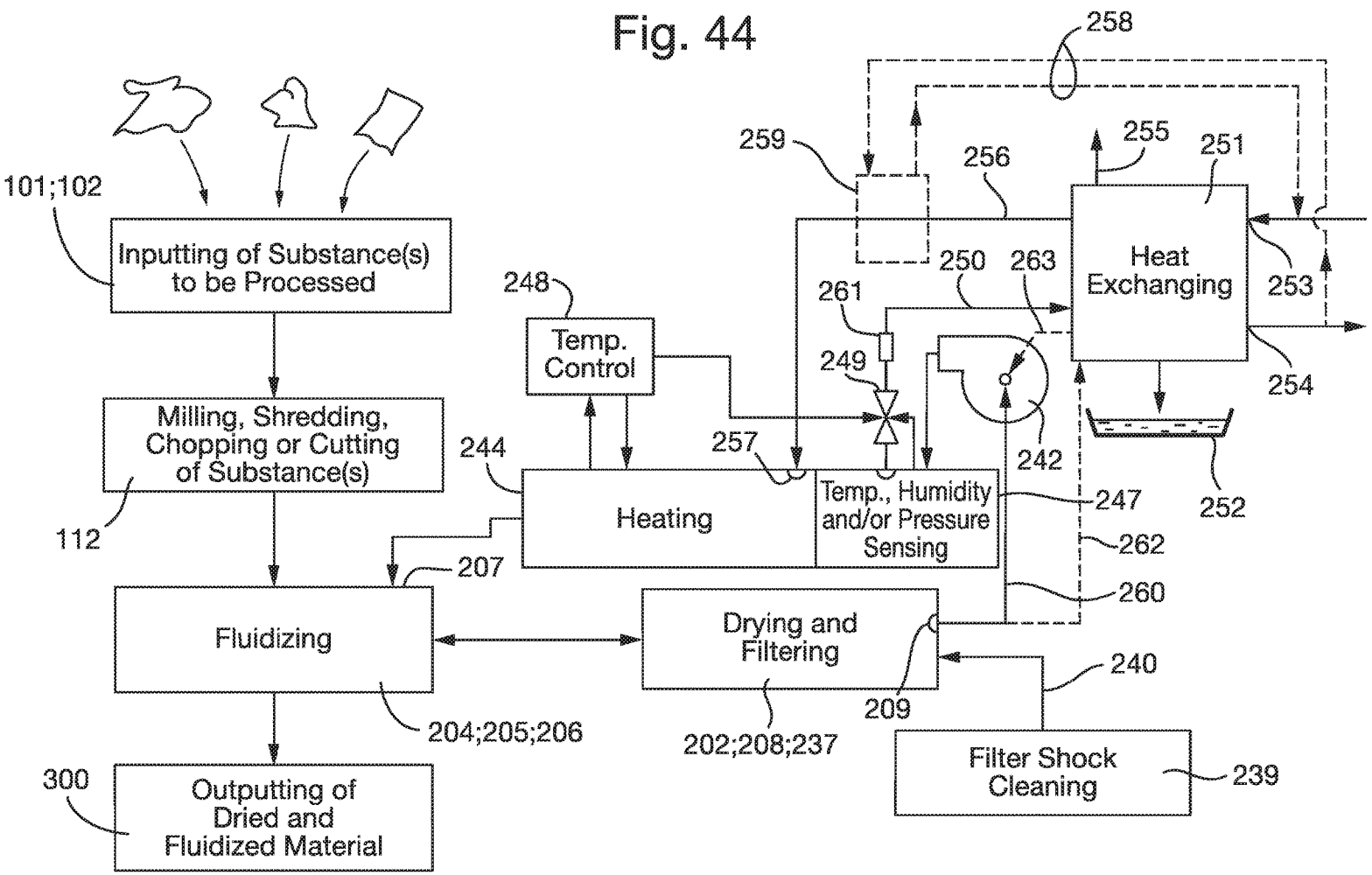
FIG. 44 is a simplified method and system flowchart.

It is to be noted from FIG. 44 that the humid drying agent, after exiting the processing space 202 through the filtering unit 208, may at least partly be passed through the pipe 250 and caused to be de-hydrated in the heat exchanger 251, whereupon the de-hydrated drying agent is passed via return pipe 256 to the heater 244 via an inlet 257 on the heater or via the pipe 263 to the fan 242 and from the fan 242 to the heater 244, thereby enabling the drying agent to be re-used in a de-hydrated state.

Supplying domestic water to the heat exchanger at inlet 253 and letting it pass out through outlet 254 will yield that the domestic water is heated and can be used for other purposes.

The de-hydrated, diverted drying agent may either pass into ambient air through an outlet 255 or more preferably be returned to an inlet 257 on the heater 244 via a return pipe 256. There is normally not any need for a flow booster in the return pipe 256, nor the booster 261 in the pipe 250. If necessary a venturi device powered by the fan 242 may be included in the heater to boost the flow return from the heat exchanger. Thereby, any remaining heat in the return flow may be used, thus requiring less heat supply from the heater 244.

In this manner, the domestic water may feed a hot water tank (not shown) at required temperature and at a rate adapted to the drying capacity of the drying space 202. The hot water tank in such a case does not require its own heater circuits, thereby saving power consumption for the heating of water.

In a variant, merely indicated by dotted line, the inlet 253 and outlet 254 of the heat exchanger 251 may be included in a closed loop 258 passing through a further heat exchanger 259 associated with the return pipe 256 to preheat the returned diverted drying agent. In such a further loop 258, a fluid having a high boiling point could preferably be used.

It may be appreciated that this arrangement could be used also for additionally heating domestic water, in which case the fluid in the loop 258 may simply be domestic water.

If inert gas is used as drying agent, then release of the de-hydrated agent through exit 255 would be unwanted, whereby re-entry through return pipe 256 would be recommendable, in particular from a cost-perspective point of view.

Vapour based drying in the space 202 is currently the preferred mode of operation, also from a safety point of view. Although the drying agent passing through the heater 244 is fairly dry, the raw material in the space will normally contain a certain amount of moisture, thereby yielding that the drying agent in the space will contain some humidity and thus be like vapour when it leaves the space 202, i.e. having a higher fraction of humidity when leaving the space 202 than when entering the space.

However, it may in some operational situations be of advantage to let the drying agent be vapour or superheated steam, dependent on the substance(s) to be processed in the space 202.

For processing e.g. grocery waste, an inlet temperature of the drying in the range 125° C.-150° C., preferably on average 135° C., could be used, yielding an outlet temperature of approx. 105° C. at the exit 209. The end product to be delivered from the space 202 through e.g. an outlet 210 would in such a case be a highly sanitary product, sterilized and substantially free of bacteria. Preferably, the outlet 210 may have a non-stick coating, such as e.g. Teflon®. Further, the shovels, the rotary shafts and the interior or the space 202 may have such a coating, or at least some of these structural parts of the module 200 could have such a coating.

An advantage of module 200 is a short drying cycle in the range of 10-30 seconds. In certain cases and for special substance(s) to be treated, superheated steam with inlet temperatures in the range of 200° C.-350° C. may be required or desirable. Even higher temperatures may be contemplated, but may require specific safety precautions.

Due to the raw material in any case being exposed to the drying agent for a very limited time of e.g. 10 seconds, if the processed substance(s) are to be edible and have storage ability, then the nutritional quality will not be deteriorated. However, in order to safely remove any harmful bacteria from certain substances and avoid oxidization thereof upon storage, longer drying exposures may be required, which may affect nutritional value to some extent.

Shredded, dried, fluidized substance(s) will exhibit a substantially reduced output volume relative to the input volume. If the substances are grocery and food waste, the end product (which is a mixture of e.g. organic and inorganic materials) can be used for e.g. producing bio-gas.

The dried product will arbitrarily move to the outlet 210. A conveyor module 300 may be linked to the outlet 210 of module 200.

A screw-type conveyor 301 is provided to be operatively linked to the outlet 210 from the space at a low location thereof, thereby enabling the end product to leave the space 202. If the conveyor does not have its input, i.e. upstream end, sufficiently into the outlet 210, then reversal of direction of rotation of the set(s) of shovels will be required, suitably using shovels with rear plates, as shown on FIGS. 21-23 and **30*a*-32, or shovels with aero-dynamic members, as shown on FIGS. 24-26 and 33*a*-35, to obtain efficient feed-out to the conveyor module 300. In such a case the conveyor must be placed with a shallow angle relative to the horizontal. The conveyor 301 has a conveying screw 302 attached to a drive shaft 303 and powered by a motor 304 and a gearbox 304'. The conveying screw rotates within a tubular housing 305. The conveying screw 302 has its downstream end 302' at a beginning 306' of a transverse feed-out region 306 for the end product. There is thereby downstream of the end of the conveying screw created a sealing zone where it be located fluidized, dry material like a continuous "plug" which thereby isolates thermally and flow-wise the fluidizing and drying space 202**.

Like the input conveyor 102 of the first module 100, the conveyor 301 has on the inside wall of the tubular housing guide rails 307 to safeguard axial transport of the end product from the outlet 210 to the feed-out region 306. The housing 305 is not thermally insulated, thereby yielding that the end product which leaves the region 306 is sufficiently cooled. The conveyor screw 302 has a wing diameter which is adapted to the largest particle size of shredded, dried substance(s) or raw material, e.g. for grocery waste like a banana skin which is typically 150 mm of straight length. Further, the transition between the space 202 and the conveyor 301 should be adapted to any largest shredded particle size to prevent any jamming thereat or a kind of bridging which could cause operational disruptions.

In order to avoid transporting by means of the conveyor 301 raw material which has not been properly dried, the conveying screw 302 of the conveyor 301 is controlled as regards its rotation so that rotation starts only a specific time after moist raw material has been shredded and fed into the drying and fluidizing space.

The end product can be discharged into a transport container 308 or a suitably located big-bag.

Figure 45:
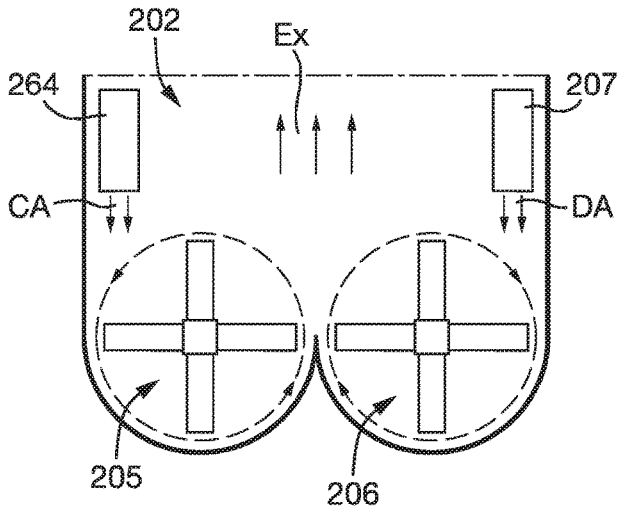
FIG. 45 is a sketch showing two sets of rotary shovels and with both drying agent and cooling agent inlets.
Figure 46:
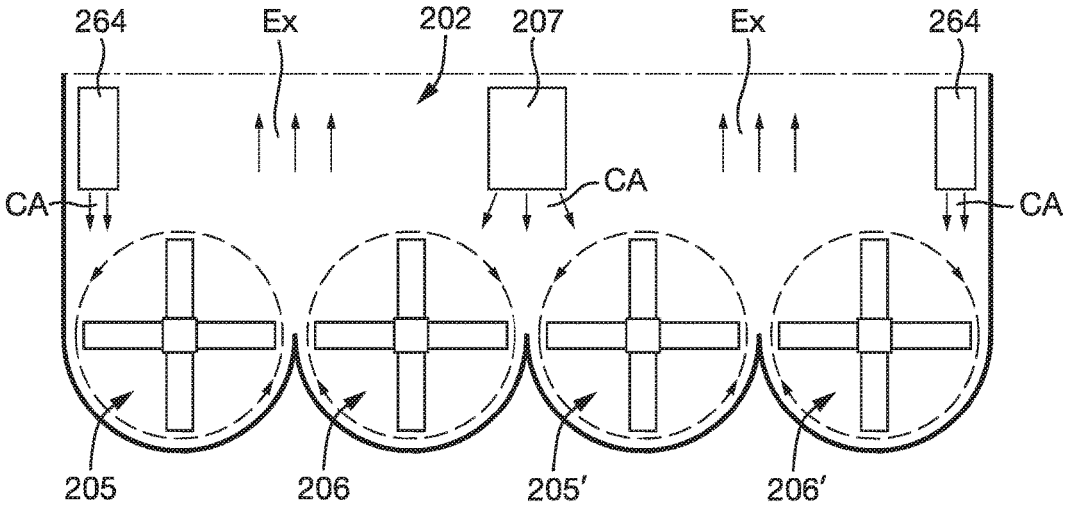
FIG. 46 is a sketch showing four sets of rotary shovels and with both drying agent and cooling agent inlets.

It is now referred to two very schematic drawings, FIGS. 45 and 46.

FIG. 45 is a sketch showing two sets of rotary shovels 205; 206 and with both drying agent and cooling agent inlets, and FIG. 46 is a sketch showing four sets of rotary shovels 205:206; 205'; 206' and with both drying agent and cooling agent inlets 207; 264.

When handling fragmented materials which are sensitive to exposure from high temperatures, it may be preferable to introduce into the fluidizing and drying space 202 a cooling agent CA via at least one input 264, in addition to the general introduction of a hot drying agent DA via at least one input 207, previously denoted as the second input into the space 202.

It is important to avoid that the fragmented materials to be dried and fluidized, or at least those of the fragmented materials in the space which are highly temperature sensitive, are exposed to temperatures which are critical and which could cause a degrading of the resulting product which is to leave the space. Drying of temperature sensitive waste materials, e.g. plastic materials, in a most effective way is challenging, as it is important to avoid any melting or degrading of such type of material. Therefore, introducing a cooling agent CA, e.g. air or cold gas, in addition to a hot drying agent DA will yield a drying and heating process with high temperature and any associated required cooling. A kind of exhaust EX is generated from the fluidized and dried substances, i.e. humidified drying agent and with addition of cooling agent.

For a machine with two sets 205; 206 of shovels, see FIG. 45, the drying agent DA may suitably enter the drying and fluidizing space or chamber 202 at one side and the cooling agent CA at the other side. However, this is not to be construed as a limitation to this part of the invention.

For a machine with four sets 205; 206 and 205'; 206' of shovels, see FIG. 46, the drying agent DA may suitably enter the drying and fluidizing space or chamber 202 at a center region input 207 and the cooling agent CA at the sides at inputs 264. However, this is not to be construed as a limitation to this part of the invention.

This part of the invention will make it possible to use quite high temperature levels for the drying agent, e.g. 400° C., in the process of drying temperature sensitive materials, e.g.

plastic materials. For some products, the moisture or water to be dried off from the material is only sited on the surface of the material, not inside the material. Thus, with a material having low specific heat capacity and using a high temperature drying and heating agent, such material will very rapidly increase its internal temperature, thereby yielding a possible material degrading or melting. If a cooling agent CA is introduced, it will prevent melting or degrading of the material to such extent that it will be possible to use the claimed methods and devices in machines which are structurally small, are energy efficient, and have small foot prints. This technical aspect of the invention will yield a very effective environmental solution.

The use of cooling agent CA may be an issue in the above case if the end product needs a rapid cooling before the end product is discharged from the processing space.

In general, if the end product, irrespective of whether a) it has not been heated, b) it has been heated to be disinfected, or c) it has been heated to be disinfected and dried, needs to be cooled before discharge from the processing space 202, a cooling agent CA may be introduced into the space before discharge of the end product from the space 202. The cooling agent may suitably be $CO_2$ snow or other type of suitable cooling material having adequate cooling properties.

It will also be appreciated from the description that if the fragmented substance(s) to be fluidized are sufficiently dry upon entry into the processing space or do not need any disinfection/sterilization through use of elevated heating, then there will be no specific need for using a heating agent, as fluidizing will be sufficient. If a cooling is needed before discharge from the fluidizing operation, a cooling agent CA may be used as just indicated.

Finally, a reference is made to drawing FIGS. 27-32 which are presented to disclose an alternative to module 300, i.e. an alternative conveyor module 500 which causes the end product to leave the space 202 in a manner different from that described for the interaction between modules 200 and 300. According to this embodiment there is provided a pair of trap doors 501, 502 which are hinge-linked at 503 and 504 to the remainder of the bottom parts 235, 236 of the lower region 204. The trap doors are movable by means of electrically operated, hydraulic or pneumatic actuators 505; 506. An advantage of this embodiment is that it may be of a more compact configuration, thus requiring less space in e.g. a grocery shop "back stage", and in the cases where only small batches of waste is processed at one time. The end product may be discharged into a container or big bag.

From the discussion above, it will be observed that the drying and fluidizing process within the space 202 is primarily directed to a process related to moist, raw and shredded material or substance(s) supplied into the space 202 and to yield dried, fluidized, shredded raw material or substance(s) out from the space 202 of the system as an end product of the system. However, as indicated, if the material or substances(s) received into and to be processed in said space 202 are sufficiently dry, then any heating thereof is merely for sanitary purposes. In some cases, the material or substance(s) received may be of a type not requiring any heating, but merely fluidizing.

The invention solves serious problems related to in particular nutritional substances by processing and disposing thereof in a hygienic manner, without—as known in the prior art—causing food waste to be stored in a wet, smelly and deteriorating way and which requires subsequent very demanding cleaning operations of collection containers to avoid insects, rats, mice, birds or other noxious animals, and any health hazard to personnel. The end product is stable as regards storage properties, as it has been substantially sterilized so that bacteria cannot cause further deterioration or fermentation which could cause smells, and the end product is therefore suitable for flexible logistics solutions until the end product, if grocery waste, is incinerated or is used for production of bio-gas.

What is claimed is:

1. A substance fragmenting device capable at an output thereof to provide said at least one substance in a fragmented state, comprising:

a feed-in means, a screw conveyor, and a shredder at a downstream end of the conveyor for fragmentation of the at least one substance before delivering it at an output of the device, the shredder comprising a set of angularly mutually spaced, stationary first knives and a set of angularly mutually spaced, rotary second knives downstream of the set of stationary first knives and in interaction therewith, and a downstream end of a conveying screw of the screw conveyor being spaced from an upstream face of said set of stationary first knives, wherein the conveying screw has a rotary drive shaft which at a downstream end thereof is attached to a smaller face of a truncated cone, wherein a larger face of the truncated cone is attached to an upstream face of a hub of the set of rotary second knives, and wherein the truncated cone along its axially extending outer face has a plurality of mutually spaced scraper rails extending therealong.

2. The device of claim 1, wherein said hub is attached to said larger face of the truncated cone by means of spring tensioned bolts.

3. The device of claim 1, wherein the scraper rails upon rotation of the truncated cone successively face an upstream region of the set of stationary first knives and downstream region of a plurality of mutually angularly spaced guide rails extending in a longitudinal direction of the screw conveyor along an inside wall thereof.

4. The device of claim 1, wherein knives of the set of stationary first knives have an upstream region which exhibits an inclined or stepped, sharp edge, and wherein a downstream end of the knives of the set of stationary first knives has a cutting face being parallel to an upstream face of the set of rotary second knives.

5. The device of claim 4, wherein each knife of the set of stationary knives, as seen in a longitudinal direction of the screw conveyor has its longest dimension where it is attached to an inside wall of the screw conveyor at a downstream wall region thereof.

6. The device of claim 3, wherein each guide rail at its downstream end joins an upstream end of a respective knife of the set of stationary first knives.

7. A device for fluidizing and drying at least one substance which in a fragmented state is received in a confined space of the device, and the space having at least one outlet enabling the fragmented, fluidized and dried substance(s) to leave said space as an end product, comprising:

at least one set of rotary shovels located in said space, the shovels of the or each set of rotary shovels being located on a common rotary shaft of the set, the common rotary shaft being configured to rotate in a first rotating mode when operating to fluidize the fragmented substance(s), the shovels of at least one set of shovels extending radially from a respective surface of the common rotary shaft, wherein each shovel, as viewed radially from the common rotary shaft, has a curved cross-section so as to present upon rotation of the set of shovels a convex surface to face the fragmented substance(s) to be fluidized, wherein the shovel at a radially outer region is forwardly flared in a direction of a fluidizing mode of rotation, i.e. in a direction of a convex side of the shovel surface, the outer region thereby having a forward face forming an angle with the rotary forwardly facing convex surface of the remainder of the shovel, wherein a concave side of the shovel between said outer region and the respective surface of the common rotary shaft is covered by a plate member extending between side edges of the shovel, and wherein a space between said concave side and the plate member is closed off to yield a sealed cavity.

8. The device of claim 7, wherein a radially extending side edge region of the shovel is provided with a wing-like side member protruding laterally from said side edge region, and wherein the wing-like side member is turned forwardly in the direction of rotation of the shovel, so as to form an angle with an edge of the convex side of the shovel and the forwardly flared region of the shovel.

9. A device for fluidizing and drying at least one substance which in a fragmented state is received in a confined space of the device, and the space having at least one outlet enabling the fragmented, fluidized and dried substance(s) to leave said space as an end product, comprising:

at least one set of rotary shovels located in said space, the shovels of the or each set of rotary shovels being located on a common rotary shaft of the set, the common rotary shaft being configured to rotate in a first rotating mode when operating to fluidize the fragmented substance(s), the shovels of at least one set of shovels extending radially from a respective surface of the common rotary shaft wherein each shovel, as viewed radially from the common rotary shaft, has a curved cross-section so as to present upon rotation of the set of shovels a convex surface to face the fragmented substance(s) to be fluidized, wherein the shovel at an radially outer region is forwardly flared in a direction of a fluidizing mode of rotation, i.e. in a direction of the convex side of the shovel surface, the outer region thereby having a forward face forming an angle with the rotary forwardly facing convex surface of the remainder of the shovel, wherein a radially extending side edge region of the shovel is provided with a wing-like side member protruding laterally from said side edge region, and wherein the wing-like side member is turned forwardly in the direction of rotation of the shovel to form an angle with an edge of the convex side of the shovel and the forwardly flared region of the shovel.

10. A device for fluidizing and drying at least one substance which in a fragmented state is received in a confined space of the device, and the space having at least one outlet enabling the fragmented, fluidized and dried substance(s) to leave said space as an end product, comprising:

at least one set of rotary shovels located in said space, the shovels of the or each set of rotary shovels being located on a common rotary shaft of the set, the common rotary shaft being configured to rotate in a first rotating mode when operating to fluidize the fragmented substance(s), the shovels of at least one set of shovels extending radially from a respective surface of the common rotary shaft, wherein each shovel, as viewed radially from the common rotary shaft, has a curved cross-section so as present upon rotation of the set of shovels a convex surface to face the fragmented substance(s) to be fluidized, wherein the shovel at an radially outer region being forwardly flared in a direction of a fluidizing mode of rotation, i.e. in a direction of the convex side of the shovel surface, the outer region thereby having a forward face forming an angle with the rotary forwardly facing convex surface of the remainder of the shovel, wherein an aerodynamic member having a drop shaped or wedge shaped configuration extends rearwards from a concave side of the shovel, transversely of the radial direction of the shovel, wherein the aerodynamic member has its widest dimension closest to said concave surface, and wherein a space between said concave side of the shovel and the aerodynamic member yields a sealed cavity.

11. The device of claim 10, wherein a radially extending side edge region of the shovel is provided with a wing-like side member protruding laterally from said side edge region, and wherein the wing-like side member is turned forwardly in the direction of rotation of the shovel, so as to form an angle with an edge of the convex side of the shovel and the forwardly flared region of the shovel.

* * * * *